US007900950B2

(12) United States Patent
Riepler et al.

(10) Patent No.: US 7,900,950 B2
(45) Date of Patent: Mar. 8, 2011

(54) SKI OR SNOWBOARD WITH A MEANS FOR INFLUENCING ITS GEOMETRY AND A METHOD OF PRODUCING IT

(75) Inventors: Bernhard Riepler, Wagrain (AT); Rupert Huber, Radstadt (AT); Helmut Holzer, St. Johann (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 378 days.

(21) Appl. No.: 12/009,774

(22) Filed: Jan. 22, 2008

(65) Prior Publication Data

US 2008/0185816 A1 Aug. 7, 2008

(30) Foreign Application Priority Data

Feb. 2, 2007 (AT) ..... A 173/2007

(51) Int. Cl.
*A63C 5/07* (2006.01)

(52) U.S. Cl. ..... 280/602; 280/601; 280/609; 280/87.042

(58) Field of Classification Search ..... 280/609, 280/607, 602, 600, 601, 603, 608, 610, 87.042
See application file for complete search history.

(56) References Cited

U.S. PATENT DOCUMENTS

| | | | | |
|---|---|---|---|---|
| 3,549,162 | A * | 12/1970 | Coutts | 280/602 |
| 3,724,866 | A * | 4/1973 | Kaplan | 280/607 |
| 3,921,994 | A * | 11/1975 | Locati | 280/607 |
| 4,275,904 | A * | 6/1981 | Pedersen | 280/818 |
| 5,551,728 | A | 9/1996 | Barthel et al. | |
| 6,000,711 | A * | 12/1999 | Fey et al. | 280/603 |
| 6,523,851 | B1 * | 2/2003 | Maravetz | 280/603 |
| 7,628,419 | B2 * | 12/2009 | Gogarty | 280/609 |
| 2005/0062259 | A1 | 3/2005 | Haas | |

FOREIGN PATENT DOCUMENTS

| | | |
|---|---|---|
| AT | 238 074 | 1/1965 |
| DE | 24 17 156 | 11/1974 |
| DE | 27 04 858 | 8/1978 |
| DE | 32 00 383 | 9/1982 |
| DE | 84 22 316 | 11/1984 |
| DE | 85 12 315 | 9/1985 |

(Continued)

OTHER PUBLICATIONS

European Search Report for EP 1 952 854 (Mar. 28, 2008).

*Primary Examiner* — Hau V Phan
(74) *Attorney, Agent, or Firm* — Collard & Roe, P.C.

(57) ABSTRACT

A ski or a snowboard in the form of a board-type gliding device has by reference to the board body width, at least one slot in its middle portion extending in the depth direction from the board body top face towards the running surface facing and in its longitudinal direction essentially parallel with the board body longitudinal direction to cause a cross-sectional weakening and reduce the stiffness of the board body transversely to its longitudinal direction. At least one geometry-influencing device produces a cross-sectional board body shape or contour which is variable manually or as a function of load. The slot is then faced with a bridging element which is elastically stretchable or expandable, at least transversely to the longitudinal extension of the slot to prevent snow from being transferred or getting inside the slot from the running surface facing towards the top face of the gliding board body.

29 Claims, 5 Drawing Sheets

FOREIGN PATENT DOCUMENTS

| | | |
|---|---|---|
| DE | 34 44 345 | 6/1986 |
| DE | 36 02 006 | 7/1987 |
| DE | 43 24 871 | 1/1995 |
| DE | 298 14 522 | 7/1999 |
| DE | 201 13 739 | 4/2002 |
| EP | 0 034 643 | 9/1981 |
| EP | 0 430 805 | 6/1991 |
| EP | 0 490 044 | 6/1992 |
| EP | 1 297 869 | 4/2003 |
| EP | 1 516 652 | 3/2005 |
| FR | 2 794 374 | 12/2000 |
| SI | 20 803 | 8/2002 |

* cited by examiner

SKI OR SNOWBOARD WITH A MEANS FOR INFLUENCING ITS GEOMETRY AND A METHOD OF PRODUCING IT

CROSS REFERENCE TO RELATED APPLICATIONS

Applicants claim priority under 35 U.S.C. §119 of AUSTRIAN Patent Application No. A 173/2007 filed on Feb. 2, 2007.

BACKGROUND OF THE INVENTION

1. Field of the Invention

The invention relates to a ski or a snowboard in the form of a board-type gliding device and a method of producing a corresponding ski or snowboard.

2. Prior Art

Patent specification EP 1 297 869 A1 discloses a gliding snowboard, in particular a ski, and a prising mechanism for its gliding board body. The width of the gliding board body can be varied across at least a partial length by means of this prising mechanism. The prising mechanism thus causes the gliding board body to prise open depending on the load or flexing of the gliding board body. This prising mechanism comprises a plurality of prising levers disposed in pairs, which cause the gliding board body to be prised apart in the region of a slot at the rear end of the ski. The slot, which becomes wider and narrower as a function of load, is therefore disposed at a rearward end of the gliding board body. When the prising mechanism is operated with a view to reducing or increasing the angle subtended by the two prising levers, the rear end of the gliding board body is prised open. In the case of another embodiment, an adjusting element may be provided, by means of which the prising element of the prising mechanism can be pre-set. With the proposed designs, the rear end of the gliding board body is slotted and the prising mechanism is integrated inside the slot or the resultant recess, which occupies approximately one third of the ski width. The described prising mechanism is of a relatively complex construction and the change which can be achieved in terms of the travel or turning behavior of the gliding board body with the previously known design can be made to a significant degree only if the rear end of the gliding board body is subjected to a relatively strong, elastic prising action. In order to obtain pronounced changes in the geometry or travel behavior of the gliding board body, therefore, it is necessary to produce strong deformations or elastic prising forces at the rear end, as a result of which the loads acting on the gliding board body can rapidly reach a problematically high degree or the desired extent of variations in the travel behavior can be achieved, but only with great difficulty due to the fact that the adjusting forces are not strong enough for the prising mechanism.

Patent specification DE 43 24 871 A1 describes a gliding board body, which may be made up of three structurally separate board-type elements. In particular, a gliding board, especially a snowboard, is made up of a total of two skis and a middle part disposed in between, additionally using plates. Disposed in the middle portion of the gliding board is a clamping means, by means of which the skis disposed to the side of the middle part can be clamped with respect to one another causing an elastic deformation in its transverse direction, thereby enabling the gliding board to be adjusted to the desired contour radius. When the two outer skis are clamped to one another by the clamping means, the gap becomes smaller and smaller as the ski becomes more deformed in the transverse direction until it disappears altogether when the two skis lie in full abutment with the middle part. As a result of this clamping action and deformation of the skis, the contour radii which are ultimately in imparted to the fully assembled gliding board or snowboard are significantly smaller than those of the skis. The disadvantage of this is that this gliding board is awkward to handle and the requisite components, in particular the plate parts, are mechanically complex and significantly increase the overall weight of the gliding board body.

Patent specification DE 34 44 345 A1 describes a so-called double-runner ski, whereby two runners of a ski extend parallel with one another and curve upwards at the two mutually joined ends. However, it is also possible to provide several, in particular three or four, runners per ski extending parallel with one another, in which case they are joined at their oppositely lying ends to form a unit. The slot between the double runners extending longitudinally down the centre is intended to permit snow which has built up in front of the tip of a ski to flow away more efficiently. Rounded inner edges of the two runners are intended to make the ski easier to rotate or turn. However, the proposed designs have only a limited use in practical applications.

Document DE 85 12 315 U1 describes a ski, the rear portion of which is split by means of a slot. The width of the slot can be made smaller and bigger by means of an adjusting element so that the rear portion of the ski can be varied in terms of the contour of its side edges. Although the slot in the rear end of the ski body enables changes to be made to the ski geometry, the extent of the changes is only satisfactory under certain conditions, given that the capacity of the rear ski end to prise open is limited by structural and design constraints.

Document DE 84 22 316 U1 describes a ski, the front and rear portion of which have longitudinally disposed slots extending from the binding mounting portion towards the front and towards the rear and terminating just short of the respective end of the ski, thereby resulting in integral, transversely stable ski ends. By means of respective co-operating adjusting elements, the width of the slots can be varied, thereby enabling the contours of the side edges to be varied independently of one another in the front and rear portion of the ski. The disadvantage of this approach is that the geometry which can be set using this construction causes the contours of the side edges to become non-homogeneous or non-uniform relatively quickly which is detrimental to the control behavior of the ski. In particular, it becomes more difficult to "ride on the edge", which is in important to the dynamics or acceleration of the ski when starting to turn, which can cause problematic skidding phases during turning.

Patent specification DE 24 17 156 A1 describes a ski comprising at least two gliding strips disposed adjacent to one another. These gliding strips are joined to one another by fixing means to permit a relative movement of the two gliding strips in the vertical direction with respect to their gliding surface, at least in their middle portion. This results in a multiple, in particular twofold, edge support, which is intended to produce a better grip to prevent lateral skidding. The mechanical coupling between the two gliding strips requires complex mechanisms, which means that a design of this type is of only limited practical value.

Patent specification FR 2 794 374 A1 discloses various designs for changing geometry, in particular of the side edge contour of a ski. In one of the proposed embodiments, both ends of the ski may be provided with slots, which extend beyond the end of the ski, resulting in longitudinally extending cuts in the oppositely lying ends of the ski. Close to the front and rear end of the ski, adjusting means are provided, which are mechanically coupled or act independently of one another and enable the respective ends of the ski to be made narrower or prised open. Although these features enable the travel properties of the ski to be influenced to a significantly higher degree, the performance which can be achieved with such a gliding device is still not particularly satisfactory.

Patent specification EP 1 516 652 A1 describes a snow gliding board, in particular a snowboard, which has a recess in at least one of its ends, in which an insert is fitted. This insert is designed so that it has at least one mound or recess on its bottom face, which is open towards the bottom face of the gliding board body. The insert is made from a permanently deformable material, in particular a thermoplastic polymer or plastic, which is permanently deformed to a cambered shape standing proud of the top face of the gliding board body during the process of manufacturing the snowboard. These recesses or cut-outs in the running surface of the snowboard are intended as a means of positively influencing the flow of snow and aiding gliding in the snow. Especially in the case of powdery snow, the intention is to produce a better guiding action for the snowboard and a reduced resistance in the rearward shovel region. In particular, the intention is to improve deep snow properties for a snowboard. An individual change in the guide properties, in particular the turning behavior, of the snowboard is not possible, however, due to the fact that the insert piece fitted in the recess is made from a permanently deformed, thermoplastic plastic material.

Document DE 201 13 739 U1 describes a snowboard, which has a slot essentially along its mid-axis, extending from the rear end of the gliding board body at least as far as its middle portion, thereby forming two rear arms separated from one another, which are joined to one another by the integral front portion. This slot extends from the rear to the front in a wedge shape tapering to a point, and the slot in the rear portion of the snowboard is wider than in the middle portion of the snowboard. In addition, this slot may merge into a recess which extends in the direction towards the front portion of the snowboard, gradually disappearing. An adjusting mechanism is also provided, which acts on the two legs of the snowboard and is provided in the form of a threaded spindle arrangement. This enables the distance between the two legs to be adjusted and to be so in the pulling direction, i.e. so that the slot becomes narrower, as well as in the pushing direction, i.e. so that the slot becomes wider. Consequently, the contour and hence the travel behavior of the snowboard can be individually varied to a certain extent. The disadvantage of this approach is that the slot in the gliding board body, which extends from the rear end across more than half of the total length of the gliding board, is made up of two legs which run away from one another independently across extensive portions and are therefore subjected to high loads. In particular, the gripping ability of the edges or tracking of such a design are only satisfactory under certain conditions because high torsional loads act on the relatively narrow legs of the snowboard during turning, which can cause relatively pronounced twisting of the legs about their longitudinal axis. Especially if edge loads occur, as is often the case with cut swinging actions in particular, the tracking and stability desired by the user are difficult to obtain.

SUMMARY OF THE INVENTION

The underlying objective of this invention is to propose a ski or a snowboard, which has manually adjustable properties and/or travel properties which can be varied as a function of load, and which detrimentally affect the performance which can be achieved with such a gliding board body as little as possible or not at all. In particular, the intention is to produce improved turning behavior and the most efficient possible gliding behavior. Irrespective of this, another objective of the invention is to propose a method of producing such a ski or snowboard.

The first of the aforementioned objectives is achieved on the basis of a board-type gliding device in accordance with the invention. The advantage of this approach is that the end user or the employee of a business hiring out the ski proposed by the invention or the snowboard proposed by the invention can better adapt the travel properties to individual wishes or to the respective prevailing conditions of usage, in particular the conditions on the ski slope. Alternatively or in combination with a manually pre-settable geometry-influencing means, a travel behavior that will primarily be of interest to individual skiers can be obtained if the geometry-influencing means causes a varying cross-sectional shape or contour as a function of the load of the gliding board body, in particular as a function of its flexing action during turning. In particular, such a geometry-influencing means may be designed so that as the load or flexing of the gliding device increases, its contour preferably becomes more pronounced. Alternatively, its contour could also become less pronounced with increased flexing. This enables a more or less aggressive or true travel or turning behavior to be generated, which has a positive influence on the travel behavior and increases the fun or enjoyment of using the board-type gliding device. One particular advantage of this gliding device with a geometry, in particular a contour, which can be varied or is variable dynamically and/or statically, resides in the fact that the gliding behavior is improved compared with known gliding devices of the generic type. In particular, a ski proposed by the invention or a snowboard proposed by the invention offers virtually the same gliding performance as a standard gliding device without slots in its end portions, in particular its front end portions by reference to the direction of travel. Specifically, the elastically stretchable and rebounding bridging element firstly advantageously guarantees sufficient variability in the width of at least one end portion of the board-type gliding device. Furthermore, an ideal gliding behavior or optimum gliding performance is obtained because the amount of snow which collects and is "pushed along in front" inside the slot of the gliding device is reduced or even prevented. In particular, the slot is not able to acts as a collection channel for snow, so that snow is largely prevented from building up or accumulating and does not therefore have to be pushed along in the gliding direction in front of the gliding device. In particular, snow or ice is prevented from piling up and pushed along in what is a front slot of the gliding device by reference to the direction of travel. A braking resistance caused by snow sliding in the slot of the gliding device is therefore easily and effectively eliminated or at least reduced. Furthermore, the travel behavior of the gliding device is improved by means of this bridging element because a swirling motion of the snow is eliminated as far as possible due to the fact that snow is not able to pass from the bottom face of the running surface facing in the direction towards the top face of the gliding device.

Also of advantage is an embodiment wherein the bridging element has at least one elastically stretchable and rebounding stretching portion, because an often reversible expansion of the bridging element can take place without increasing the risk of damage to the bridging element. In particular, such a bridging element remains fully functional even after repeated stretching and rebounding.

The advantage of the embodiment wherein the bridging element has at least one reversibly variable stretching portion in its cross-sectional shape is that a bridging element which does not have a high ability to stretch is provided. The essential thing about this is that even after a plurality of stretching and rebounding cycles, there is barely any evidence of fatigue or tearing. Furthermore, only a relatively low amount of adjusting force is necessary to make the bridging element stretch.

Primarily due to the features wherein the bridging element has at least one elastically stretchable and rebounding stretching portion and wherein the stretching portion is provided in the form of at least one loop-shaped deflection or shape of the cross-sectional contour of the bridging element, a bridging element is provided which has an adequate ability to stretch or an adequate expansion width and stress on the material can be kept to a minimum. Furthermore, relatively low forces are already enough to produce an appropriate stretching or widening of the bridging element. A bridging element of this type also has a high mechanical robustness. In particular, a bridging element of this type has a long service life because even after numerous expansions and compressions of the bridging element, its material exhibits barely any signs of fatigue.

As a result of the features wherein the bridging element has at least one elastically stretchable and rebounding stretching portion, wherein the stretching portion is provided in the form of at least one loop-shaped deflection or shape of the cross-sectional contour of the bridging element, and wherein an apex line of the deflection or shape of the bridging element lies above a gliding surface of the running surface facing or the features wherein the bridging element forms at least one recess in the gliding surface of the running surface facing extending essentially parallel with the longitudinal centre axis of the gliding board body, a recess or guide groove is provided in the gliding surface of the gliding board body which helps to improve the travel properties. In particular, this improves the tracking and travel of the gliding board body in a straight line.

As a result of the features wherein the bridging element has at least one elastically stretchable and rebounding stretching portion, wherein the stretching portion is provided in the form of at least one loop-shaped deflection or shape of the cross-sectional contour of the bridging element and wherein the bridging element has two upwardly pointing deflections of a dome shape as viewed in cross-section, extending in the longitudinal direction of the gliding board body, the demands placed on the intrinsic elasticity of the material used for the bridging element are reduced. In particular, a bridging element can be provided which remains functionally stable in the long term and has a high mechanical stability with respect to external force acting perpendicular to the running surface of the gliding board body.

As a result of the features wherein the bridging element contains woven fabric or textile substances or is formed by a plastic layer, the thickness of which approximately corresponds to a thickness of the running surface facing or wherein the bridging element has a thickness of 0.1 mm to 2 mm, in particular a thickness of approximately 1 mm, the bridging element provided is sufficiently flexible but is nevertheless reliably able to withstand loads.

As a result of the features wherein the bridging element is made as a separate component for the gliding board body and is positively joined to the gliding board slats extending on either side of the longitudinal axis of the slot by its side peripheral portions extending essentially parallel with boundary edges of the slot, in particular is adhered or thermoplastically welded, a connection is obtained between the bridging element and the edge or wall portions of the gliding device bounding the slot which is particularly resistant to being torn out. As a result of this connection, which extends across a large surface area and is as far as possible uninterrupted in the peripheral portions, the formation of waves transversely to the longitudinal direction of the bridging element is prevented in the most efficient way. Moreover, the risk of the bridging element working loose from the bottom face of the gliding board body is minimized.

The embodiment wherein a width of the bridging element is bigger than a clearance width of the slot to be bridged is of advantage because the peripheral portions of the bridging element produce a sufficiently large connection and bonding edge, thereby resulting in a particularly strong and durably reliable connection of the bridging element to the peripheral portions of the gliding board body that will not tear apart.

As a result of the embodiment wherein the bridging element merges into the running surface facing steplessly and/or without leaving any gaps at its side peripheral portions by means of its bottom face, sharp-edge transitions are advantageously avoided between the running surface facing and the bridging element. In particular, the gliding behavior of the gliding board body is improved as a result and the occurrence of wear or the occurrence of abrasion is kept to a minimum in the transition portion between the running surface facing and the bridging element.

The embodiment wherein the bridging element and the running surface facing are formed by an integral plastic layer which extends seamlessly and without interruption between the two outer edges or control edges of the gliding board body totally rules out the risk of the layers coming apart or of the bridging element working loose. In particular, an especially robust lining or bridge of the longitudinal slot is achieved, especially in the portion of the gliding board body where the strength or stiffness is weakened.

As a result of the features wherein the bridging element is designed so that it is able to withstand an elastic expansion of up to 10 mm in its width in the end portion of the gliding board body without sustaining damage, the travel behavior of the gliding board body can be significantly varied without in impairing the service life or functionality of the gliding board body.

The advantage of the embodiment wherein the slot splits or divides the strength-imparting top belt and the strength-imparting bottom belt essentially within the longitudinal extension of the slot into a first and a second top belt strand and into a first and a second bottom belt strand is that the layers that are crucial to the strength or transverse stiffness of the gliding device are cut or slotted at their longitudinal center so that a pronounced or sufficiently noticeable change can be achieved in the contour or cross-sectional shape of the gliding board body. In particular, a significant change in cross-section can be achieved using especially lightweight and simple means for influencing the cross-section.

The advantage of the features wherein the slot extends or several slots aligned in a row with one another in the longitudinal direction of the gliding board body extends across 40% to 80%, preferably approximately across 60%, of the length of the gliding board body is that a change in the contour can be guaranteed that is as homogeneous and uniform as possible. In particular, abrupt contour changes in the contour and hence the so-called side-cut can be avoided.

The advantage of the embodiment wherein the slot extends across 50% to 95%, preferably across approximately 80%, of the front longitudinal portion between a binding mechanism and the front end of the gliding board body is that a pronounced change can be in imparted to the travel or turning behavior of the gliding board body even with the relatively low adjusting forces expended by the geometry-influencing means.

As a result of the feature wherein the slot also extends through the front, upwardly curved shovel portion and extends completely through its layers imparting transverse stiffness, the change which can be obtained in the cross-section or so-called side-cut of the gliding board body is advantageously relatively pronounced. Furthermore, a contour of the side edges of the gliding board body is guaranteed that is more favorable and as uniform or arcuate as possible.

As a result of the advantageous embodiment wherein a first slot extends from a front end portion of a mounting portion for a binding mechanism in the direction towards the front shovel portion of the gliding board body and a second slot extends from a rear end portion of a mounting portion for a binding mechanism in the direction towards the rear end of the gliding board body, the maximum achievable change in the cross-section or geometry of the gliding board body is advantageously relatively pronounced, even under the effect of a moderate or average force via the geometry-influencing means and loads occurring during travel. Providing slots extending longitudinally along the centre in the front and in the rear end portion of the gliding board body can produce a pronounced change in the geometry or contour radii of the gliding board with relatively short stretching or opening of the slot-type orifices or cuts in the gliding board body.

The embodiment wherein the geometry-influencing means is designed so that a width of the slot can be individually adjusted and pre-set permits a static pre-setting of the respective desired geometry of the gliding board body to suit the individual wishes of the user.

As a result of the features wherein the geometry-influencing means is designed to cause a variability in the width of the slot as a function of the load or flexing of the gliding board body, a dynamic change occurs in the geometry of the gliding board body during use, thereby in imparting better agility to the gliding board body.

As a result of the advantageous features wherein the geometry-influencing means has at least one prising means for individually and adjustably increasing the width of the slot and/or at least one prising means for varying the width of the slot as a function of the flexing of the gliding board body, the contour radius of the gliding board body can be switched from a pre-defined initial or non-operating state defined by the design to a contour radius which becomes increasingly small.

A particularly robust embodiment of a geometry-influencing means based on an advantageous design occurs wherein the geometry-influencing means has at least one prising means for individually and adjustably increasing the width of the slot and/or at least one prising means for varying the width of the slot as a function of the flexing of the gliding board body, and, by reference to a plane extending essentially parallel with the running surface facing, the prising means has at least two support or guide surfaces extending at an angle with respect to the longitudinal axis of the gliding board body, which co-operate with thrust surfaces on the top face of the gliding board body or with longitudinal side walls of the slot, or wherein the thrust surfaces are formed on projections fixedly connected to the gliding board body, such as screws or screw heads, for example. In particular, high adjusting forces can be transmitted between the geometry-influencing means and the gliding board body without the need for complex or expensive modifications to the ski or snowboard.

Also of advantage is an embodiment wherein the top layer is provided in the form of a plastic layer and lines the predominant part-portion of the top face as well as mutually facing longitudinal side walls of the slot, because it results in a gliding board body which is highly suitable for every day use and the risk of layers within the sandwich construction of the ski or snowboard coming apart is virtually eliminated. Furthermore, it helps to produce an especially attractive appearance because a larger surface is available for graphic designs.

The advantage of the features wherein the at least one slot extends essentially in a V-shape or dovetail shape when the top face of the gliding board body is viewed from above, and the biggest width of the slot is disposed in the end portion remote from the binding mounting portion is that the gliding board body is weakened as little as possible in portions where the highest loads occur, but has a relatively high elasticity or flexibility and ability to change shape in those portions which are decisive in terms of influencing the geometry or travel behavior of the gliding board body.

The advantage of the embodiment wherein the at least one slot has a length of between 20 cm and 100 cm when the top face of the gliding board body is viewed from above and a width or a clearance width of the slot is between 10 mm and 20 mm in its longitudinal middle portion is that the resultant gliding board body is able to withstand the loads which occur under standard conditions of use without any difficulty but this gliding board body nevertheless permits a pronounced change in its geometry, in particular its travel or "carving behavior". In particular, as a result of the dimensions specified for the length and more especially the width of the slot, the gliding board body obtained has a high robustness because the loads acting on the elastically stretchable bridging element, in particular the compression loads extending perpendicular to the running surface facing, can be absorbed without any increased risk of damaging or excessively straining the elastically stretchable bridging element.

Also of particular advantage is an embodiment wherein side peripheral portions for providing a connection of the bridging element to the mutually facing longitudinal side walls of the slot are positioned closer to the running surface facing than the top face of the gliding board body relatively speaking because a groove that is as shallow as possible or a relatively flat recess is formed in the gliding surface, in particular in the running surface facing, which has a positive effect on the gliding behavior of the gliding board body. Furthermore, sharp edges or high steps are avoided in the longitudinal middle portion of the running surface facing, thereby minimizing the risk of sudden jamming of the gliding surface in the ground underneath when the gliding board body is in use.

Also of advantage is the embodiment wherein a profile height of the bridging element decreases progressively from an cuter end of the gliding board body in the direction towards the binding mounting portion because a bridging element of this design is optimum in terms of satisfying the requirements placed on the individual longitudinal portions of the gliding board body. In particular, a bridging element of this type has a high capacity to stretch in the outer end portions of the gliding board body, whereas in the end portion lying closest to the binding mounting portion and in which the slot is relatively narrow, the bridging element occupies a relatively small volume. Especially if the gap dimension of the slot decreases constantly from the tip or end region of the gliding board body in the direction towards the binding mounting portion, the claimed profiling or contour of the gliding board body is particularly practical. A particular advantage resides in the fact that with a bridging element of this design, a significantly better gliding performance or gliding ability can be obtained based on a gliding board body with variable geometry.

The second of the aforementioned objectives is achieved on the basis of a manufacturing method in accordance with another aspect of the invention. The advantage of this approach is that a manufacturing method is proposed, which enables a durable connection to be produced between the elastically stretchable bridging element and the gliding board body in only one heat press cycle. Furthermore, due to the elasticity of the bridging element, an efficient seal is produced, thereby preventing an adhesive which melts under the effect of temperature from leaking out or spilling between the running surface facing and the bridging element. In particular, the elastically stretchable bridging element reliably prevents adhesive from getting into the region of the slot when the gliding board body is being produced, thereby ruling out any contamination of the surface or top face of the elastically stretchable bridging element or the components lying around it with sticky substances. All in all, this manufacturing method results in a slotted gliding board body with an elastically stretchable bridging element for the slot-type cut and the specified manufacturing method lends itself to the most rapid possible production, and above all an approach to production that requires very little in the way of finishing operations Another advantage of this manufacturing method resides in the fact that a high-strength connection is produced between the elastically stretchable bridging element and the peripheral portions around the slot in the gliding board body.

The advantage of the features wherein the internal surface of at least one pressing mould has a contour or shape designed so that the bridging element is supported by at least one of the pressing moulds having been introduced into the hot press and/or is positioned correctly and in an exact fit by means of the contour or shape of at least one of the pressing moulds relative to the mould interior is that the bridging element can be positioned rapidly and in an exact fit inside the pressing mould for the running surface facing. Moreover, any undesirable slipping of the bridging element and/or the slotted running surface facing can be simply and effectively prevented when the various layers are being positioned, when injecting the filler or adhesive foam and/or when closing the pressing mould.

The features wherein, during the hot pressing operation to provide an adhesive join between the layers inserted in the hot press, the bridging element is also adhesively joined to the gliding board body at its peripheral portions and bridges the slot in the gliding board body in an elastically stretchable and rebounding arrangement are of advantage because with only one heat pressing operation, the individual plies or layers of the gliding board body can be joined to one another and the elastic bridging element bridging the slot can be secured at the same time. This results in a high-strength and particularly durable connection between the bridging element and the gliding board body. This also obviates the need for separate connection processes, which would be lengthy and would increase production costs.

The surfaces of the bridging element are even more reliably prevented from being soiled with adhesive, in particular leakage of hot-melt adhesive, from the interior of the gliding board slats, which could otherwise be deposited on the transition zones to the bridging element, as a result of the features wherein, when the hot press is closed, a pressing force is exerted on the surface of the elastically stretchable and rebounding bridging element which acts starting from at least one of the pressing moulds of the hot press in order to ensure a tight seal of the mould cavity of the hot press and prevent adhesive from getting out of the mould cavity and moving in the direction towards the slot or in the direction towards the top face of the bridging element.

Also of advantage are the features wherein a sealing edge on at least one of the pressing moulds, in particular a web-type sealing lip, is forced into the surface of the elastic bridging element and produces a seal whilst the hot press is closed and active because there is no need for additional manufacturing steps and the manufacturing process used is based on as few processing steps as possible. A particularly reliable seal and separation is also obtained between the molten or runny adhesive layers of the gliding board body and the elastically stretchable bridging element during the manufacturing process.

The features wherein a transition portion between the bridging element and the longitudinal side walls of the slot is produced which does not require any finishing work when the multi-layered gliding board body is removed from the hot press and in particular there is no need for milling or polishing operations in the transition portion between the elastically stretchable bridging element and the longitudinal side walls of the slot are also of advantage because a reproducible manufacturing method is proposed, by means of which attractive and high-quality gliding board bodies can be produced without complicated or complex and cost-intensive finishing operations in the transition region between the bridging element and the gliding board slats lying on either side of the slot.

The advantage of the features wherein the top layer is provided with a slot in at least one end portion in its longitudinal direction prior to being introduced into the hot press so that the top layer lines at least portions of the longitudinal side walls of the slot during the hot pressing operation is that at least certain portions of the boundary surfaces of the slot in the gliding board body are lined with the liquid-proof top layer, thereby minimizing the risk of the multi-layered gliding board body coming apart. Furthermore, a gliding device with a visually attractive appearance can be produced with the simplest of production techniques.

Finally, the features wherein the layer for forming the top belt, the component for forming the core and the layer for forming the bottom belt are provided with slots in at least one end portion in their longitudinal direction prior to being introduced into the hot press so that the gliding board body is produced with a slot in its longitudinal direction during the hot pressing operation when the layers introduced into the hot press are being adhesively joined are of advantage because the gliding board body, which is partially slotted in its longitudinal direction, is already formed during the heat pressing operation. In other words, it is not necessary to form a slot in a multi-layered gliding board body subsequently and in particular, milling or cutting processes are not necessary to produce a split or gap in the strength-imparting layers in the longitudinal direction of the gliding board body.

BRIEF DESCRIPTION OF THE DRAWINGS

Advantageous embodiments of the invention will be explained in more detail below with reference to examples of embodiments illustrated in the appended drawings. Of these.

DETAILED DESCRIPTION OF PREFERRED EMBODIMENTS

Figure 1:
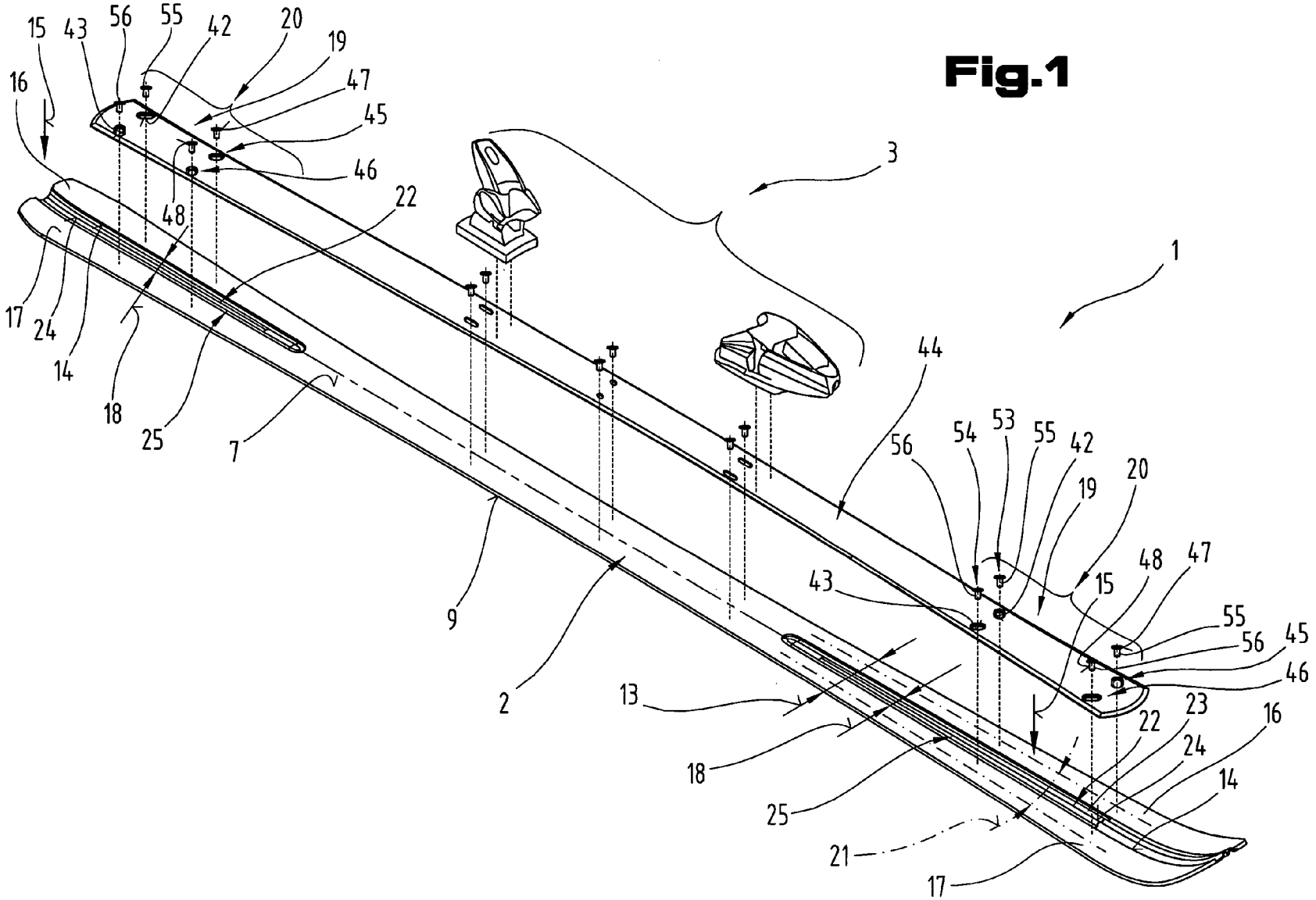
FIG. 1 is a simplified perspective view of a board-type gliding device, in particular a ski, with a slot extending longitudinally down the centre and a geometry-influencing means for producing a cross-sectional geometry which can be varied as a function of load.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

FIGS. 1 to 6 illustrate a preferred embodiment of a board-type gliding device 1 with a geometry which can be varied as a function of load. In particular, the schematically illustrated ski 2 has a cross-sectional geometry or contour which varies depending on the prevailing load when upended on the lateral control edges. In these drawings, only the components which are the most essential are illustrated by way of example. Also in the individual drawings, only the most essential parts of components are illustrated, in particular of the gliding board base body and the means for influencing the geometry of the gliding board body.

By preference, the board-type gliding device 1 is a ski 2 or a snowboard. In a known manner, such a ski 2 is used in pairs, whereas the user of a snowboard is supported with both feet on a single board body. In order to connect the feet of the user to the gliding device 1, the latter has a least one binding mechanism 3, which may be designed as a safety-release binding or a binding which provides a coupling without flexing.

The board-type gliding device 1 is based on a sandwich or monocoque structure. In other words, a plurality of layers are joined to one another by adhesive and together constitute the one-piece gliding device body. In a known manner, these layers form at least one top belt 4 which imparts strength, at least one bottom belt 5 which imparts strength and at least one core 6 disposed in between. The top belt 4 and/or the bottom belt 5 may be made from at least one plastic layer and/or metal layer and/or fibre layer and/or epoxy resin layer and such like. In a known manner, the core 6 may be made from wood and/or from foamed plastics. The core 6 therefore essentially spaces the top belt 4 apart from the bottom belt 5 of the gliding device 1, both of which impart strength.

Figure 4:
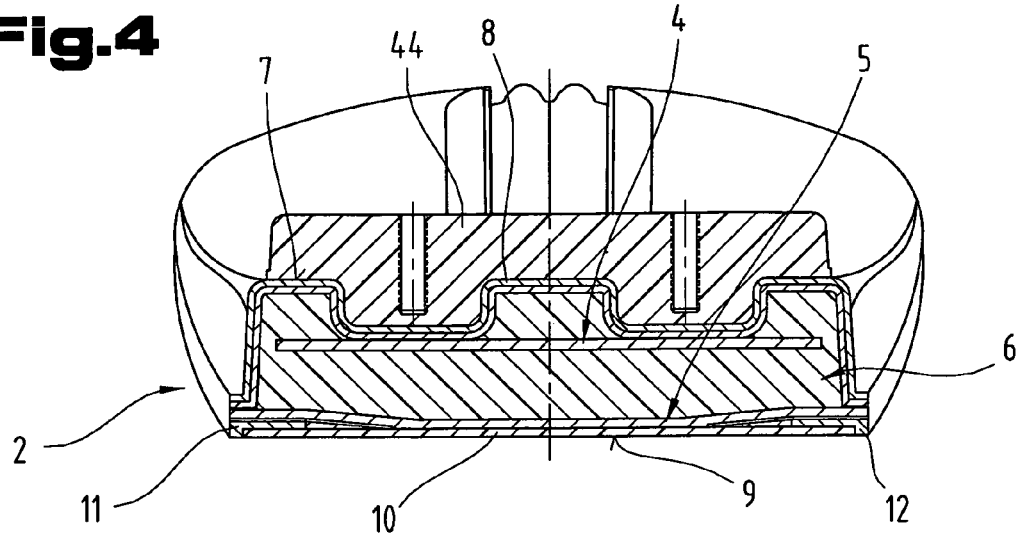
FIG. 4 shows the ski illustrated in FIG. 3, viewed in section along line IV-IV indicated in FIG. 3.

The top face 7, i.e. the top external face of the gliding device 1, is formed by a top layer 8, which primarily fulfils a protective and decorative function. The bottom face 9, i.e. the bottom surface of the gliding device 1, is formed by a running surface facing 10, which should have the best possible gliding properties with respect to the ground underneath, in particular with respect to snow or ice. In this respect, the top layer 8 may also extend across at least certain regions of the side faces of the board-type gliding device 1 and form a box-type structure in conjunction with the running surface facing 10, as may be seen in particular from the diagram in cross section shown in FIG. 4. The side edges of the running surface facing 10 are preferably bounded by control edges 11, 12, preferably made from steel, to permit an exact as possible and largely slip-free guiding action of the gliding device 1, including on relatively hard ground. The control edges 11, 12 which are key to controlling and guiding the gliding device 1, are rigidly joined to the structure, in particular to the running sole or bottom belt 5 of the gliding device 1. The control edges 11, 12 are preferably positively and non-positively fixed in the gliding device structure in a manner known per se. Similarly, the running surface facing 10 is permanently joined to the gliding device structure, in particular to its bottom belt 5, across its entire top flat face directed towards the core 6. The running surface facing 10 is preferably adhered to the surrounding components of the gliding device 1 by its entire surface. The running surface facing 10 or bottom face 9 of the gliding device 1 is of a flat or straight design in cross-section, as illustrated in FIG. 4, when the gliding device 1 is in its original state not placed under load, in which case the gliding device 1 in the initial state free of load has an essentially flat bottom face 9 and running sole.

The structure described above is decisive in determining the strength of the board-type gliding device 1, in particular the bending behavior and torsional stiffness. These strength values are predefined or predetermined by the materials used and layer thicknesses and by the methods used for joining purposes. The essential factor is that the specified board-type gliding device 1 has at least one geometry-influencing means 19 which produces a cross-sectional geometry or contour of the gliding device 1 which results in a cross-sectional geometry or contour of the gliding device 1 which is variable as a function of load and/or can be manually varied, in particular which can be pre-set. By contour is meant the so-called "side-cut" or side edge radius of the gliding device 1. The contour of the gliding device 1 which is predefined by its design therefore results in a width 13 of the gliding device 1 which can be varied in the longitudinal direction of the gliding device 1.

By reference to the width 13 of the gliding device 1, the geometry-influencing means 19 of the gliding device 1 has at least one slot 14 disposed at least in the middle portion of the gliding device 1. This slot 14 in the gliding board body extends, with respect to its longitudinal extension, in the longitudinal direction of the gliding device 1 and, with respect to its depth direction—arrow 15—from the top face 7 of the gliding device 1 in the direction towards the running surface facing 10. By reference to its longitudinal direction, the at least one slot 14 extends essentially parallel with the longitudinal direction of the gliding device 1, as may best be seen from FIG. 1. The at least one slot 14 along the longitudinal middle portion of the ski 2 is dimensioned and designed so that it causes a cross-sectional weakening of the gliding device 1 and in particular reduces the stiffness or dimensional stability of the gliding device 1 transversely to its longitudinal direction.

As may best be seen from FIG. 1, the slot 14 is disposed at least in the front portion, i.e. in the part-portion between the binding mechanism 3 and the front end of the gliding device 1. By preference, such a slot 14 may also be provided in the rear portion of the gliding device 1, i.e. in the portion between the binding mechanism 3 and the rear end of the gliding device 1. Alternatively, the at least one slot 14 may also extend across a binding mounting portion of the gliding device 1, i.e. continuously from the front end of the gliding device 1 in the direction towards the rear end of the gliding device 1. In this case, in the region of the longitudinal middle portion of the gliding device 1, in particular in its binding mounting portion, this slot 14 extends across only a part-portion of the cross-sectional height of the gliding device 1 so that a groove is formed in the binding mounting portion.

Disposed in at least one end portion but preferably in both end portions of the gliding device 1, the slot 14 extends through all the components of the gliding board body or gliding device 1 in at least one of the end portions of the gliding device 1. In other words, the at least one slot 14 forms a split end portion of the gliding device 1 in at least one of the end portions of the gliding device 1.

The slot 14 therefore defines at least one dovetail-shaped end portion on at least one end of the gliding device 1. This slot or split in the front and/or rear end of the gliding board body results in at least a first and a second gliding board slat 16, 17 at each end portion of the gliding device 1. The first and second gliding board slat 16, 17 are therefore able to move independently relative to one another. This means that the first gliding board slat 16 is largely uncoupled from the second gliding board slat 17 in a static or mechanical respect if one considers only the actual gliding board body, as illustrated by way of example in FIG. 2. This mechanical uncoupling is caused by the slot 14 lying between the first and second gliding board slat 16, 17, which extends from at least one of the outermost ends of the gliding device 1 in the direction towards the longitudinal centre of the gliding device 1. In particular, the slot 14 splits at least one end portion of the gliding device 1 completely, i.e. through its entire cross-sectional height, and the slot 14 also extends to the outermost end of the gliding device 1 forming the dovetail-shaped end portion of the gliding device 1, in particular of the ski 2, defined above.

Figure 5:
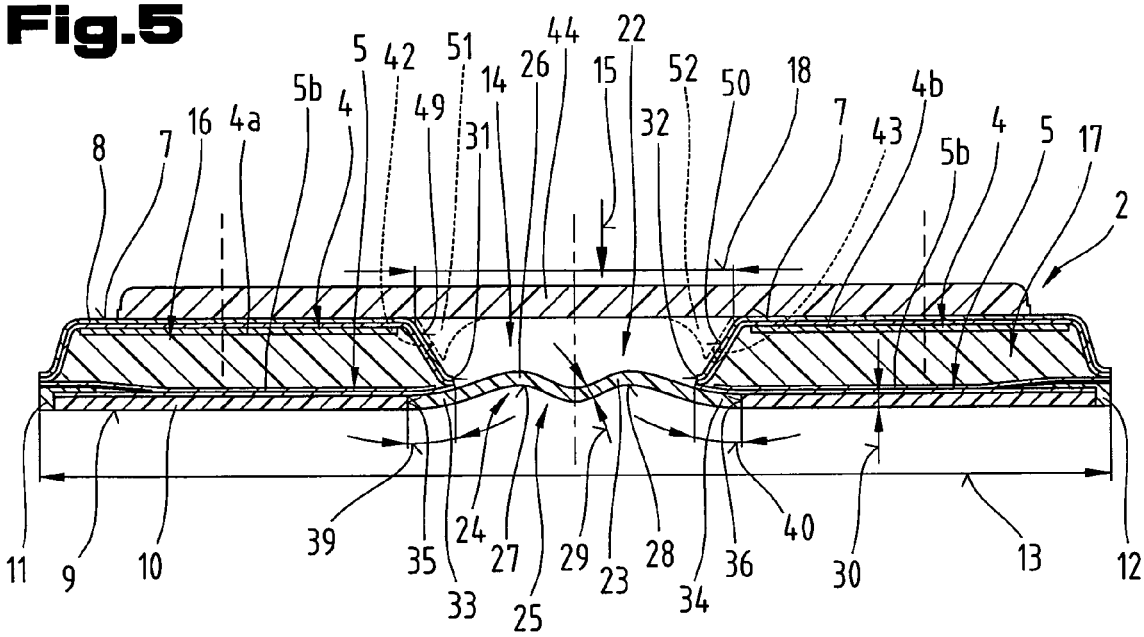
FIG. 5 shows the ski illustrated in FIG. 3, viewed in section along line V-V indicated in FIG. 3.
Figure 6:
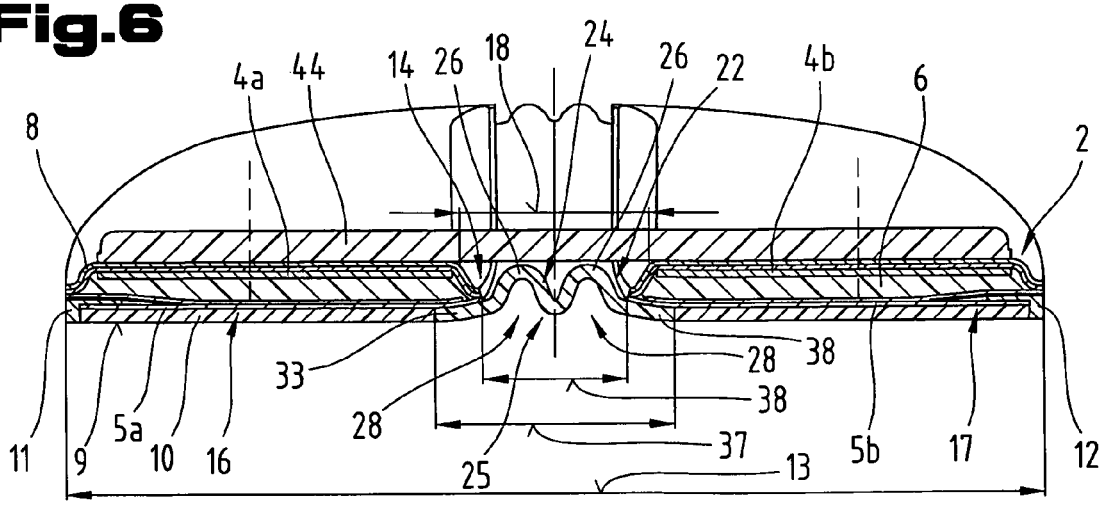
FIG. 6 shows the ski illustrated in FIG. 3, viewed in section along line VI-VI indicated in FIG. 3.

As may be clearly seen from the diagrams shown in FIGS. 5, 6, in terms of the static aspect or strength of the gliding device 1, the at least one slot 14 divides or splits the relevant top belt 4 into a first or left-hand and a second or right-hand top belt strand 4*a* and 4*b* essentially within the longitudinal extension of the slot 14. In other words, due to the presence of the slot 14, the top belt 4 is interrupted or split essentially within the longitudinal portion of the slot 14 and is subdivided into at least two top belt strands 4*a*, 4*b*. The same applies to the bottom belt 5, which is likewise divided or split at least within the longitudinal portion of the slot 14 into a first or left-hand and a second or right-hand bottom belt strand 5*a* and 5*b*. The strength-imparting top belt 4 and also the strength-imparting bottom belt 5 are therefore split or interrupted by means of the longitudinally extending slot 14 so that the transverse stiffness of the gliding device 1 is significantly reduced and in particular, the gliding board slats 16, 17 formed as a result are able to move relative to one another when the gliding device 1 or ski 2 is subjected to edge loads accordingly and/or if an appropriate geometry-influencing means 19 is used, for example a manually pre-settable adjusting means, in particular a prising means 20.

In order to permit an appropriate elastic cross-sectional deformation, in particular a stretching or widening of the cross-sectional width transversely to the longitudinal direction of the gliding device 1 and in the plane extending essentially parallel with its running surface facing 10 when the gliding device 1 is being used under real conditions or load, the slot 14 extends or several slots 14 aligned in a row in the longitudinal direction of the gliding device 1 extend across 40 to 80%, preferably approximately 60%, of the length of the gliding device 1. Alternatively or in combination, the slot 14 disposed at the front end of the gliding board body extends across 50% to 90%, preferably across approximately 75%, of the portion between the binding mechanism 3 and the front end of the gliding device 1.

It is of particular advantage if the slot 14 extends as far as the front shovel portion of the ski 2 and is therefore also disposed in the shovel portion, as illustrated in FIG. 1 for example. In particular, it is of advantage if the slot 14 extends within the front shovel portion continuously as far as the front end of the ski tip. The upwardly curved shovel portion, which has a relatively high transverse strength as a result of this curvature, is decisively influenced as a result in terms of its torsional or transverse strength, which enables the requisite stability requirements of such a ski 2 with at least one split end portion to be satisfied on the one hand and enables the desired elastic deformations to occur on the other hand. These elastic deformations can be generated as bending loads are applied to the ski 2 during use and are produced under the effects of adjusting forces of an individually adjustable adjusting means. On average, the respective cross-section influencing means 19 is able to produce changes of up to 6 m in the effective radius of curvature of the ski 2. In particular, it is able to produce a change in the range of several metres in the contour radius of the ski 2 without having to use structurally complex or intensive means and without significantly increasing the weight of the ski 2. Such an adjustment range for the effective radius of curvature which can be achieved with such a ski 2 using its control edges 11, 12 on underlying ground covered with snow, is also clearly perceptible or noticeable to users with average ability and users who engage in the sport only occasionally. This increases acceptance of using it and significantly increases the pleasure of using such skis 2.

A width 18 of the slot 14 preferably becomes smaller starting from the top face 7 of the gliding device 1 in the direction towards the running surface facing 10. In other words, the slot 14 is preferably wedge-shaped in the direction towards the running surface facing 10 as viewed in cross-section and the biggest width 18 is disposed in the region merging into the top face 7 of the gliding device 1.

As may also be seen from the diagrams shown in FIGS. 1 and 3 to 6, the board-type gliding device 1 is provided with at least one geometry-influencing means 19 as a means of varying or influencing the cross-sectional geometry of the gliding device 1 in at least one of the end portions of the gliding device 1. In the embodiment illustrated as an example, the geometry-influencing means 19 is provided in the form of a prising means 20, which causes a variation in the width 18 of the slot 14 as the gliding device 1 flexes due to load and thus changes the contour or width 13 of the gliding device 1 within the longitudinal extension of the slot 14 as a function of load. To this end, the prising means 20 is designed so that the two gliding board slats 16, 17 are prised apart from one another transversely to the longitudinal direction of the gliding device 1 and essentially parallel with its running surface facing 10 when the gliding device 1 is subjected to a flexing movement such as will occur above all when turning with the gliding device 1, in particular when performing what is referred to as "carving". The greater the flexing of the gliding device 1 is, the wider the slot 14 will open or the greater a prising angle 21 will be produced between the longitudinal centre axes of the two adjacently lying gliding board slats 16, 17. The prising means 20 therefore makes at least one end portion of the gliding device 1 wider when the corresponding end portion of the gliding device 1 flexes accordingly about a transverse axis of the gliding device 1, as may clearly be seen from the diagrams of the geometry-influencing means 19 illustrated in FIGS. 1 and 3.

The essential thing is that the at least one slot 14, which splits the strength-imparting components or plies and layers of the gliding device 1 in at least one end portion of the gliding devices 1 and thus forms two gliding board slats 16, 17 extending substantially parallel with one another in at least one of the end portions of the gliding device 1, is provided or covered with an elastically stretchable bridging element 22. This elastically stretchable bridging element 22 is preferably formed by an integral, elastically stretchable and rebounding plastic layer 23, thereby forming a bridging element 22 between the two gliding board slats 16, 17 which varies in width. In particular, the elastically stretchable bridging element 22 is designed so that it can stretch and rebound elastically at least transversely to the longitudinal extension of the slot 14 or gliding device 1 elastically. The ability of the bridging element 22 to stretch and rebound is imparted by the intrinsic elastic properties and/or shape of the plastic layer 23 and/or the shape, in particular the cross-sectional shape of the bridging element 22. In particular, the bridging element 22 or plastic layer 23 may be provided with at least one expansion fold 24 or similar to impart shapes with a varied width, such as a fold-type deflection, arcuate indentation or similar.

The bridging element 22 is also designed so that snow is prevented from getting or being transferred inside the slot 14 from the running surface facing 10 in the direction towards the top face 7 of the gliding device 1. The bridging element 22 therefore fulfils the function of a barrier layer which is able to stretch and rebound elastically, at least the in transverse direction, which also prevents snow or ice from getting to or being transferred between the bottom face 9 and the top face 7 of the gliding device 1 and vice versa. The bridging element 22 may therefore constitute an elastically stretchable intermediate piece of the running surface facing 10, as may be seen in particular from FIGS. 5, 6.

The bridging element 22 for the slot 14 in the running surface facing 10 or in the gliding device 1 therefore has a stretching portion 25 which has a reversibly variable cross-sectional shape and in particular is able to stretch and rebound elastically. If the elasticity of the bridging element 22 is sufficiently high, in particular if the plastic layer 23 is made from an elastomeric or rubber-type material, it is possible to provide a plate-type or flat plastic layer 23 between the two gliding board slats 16, 17.

The bridging element 22 can preferably be reversibly varied in terms of its cross-sectional shape, in particular can be widened and compressed. To this end, the bridging element 22 may be provided with the expansion fold 24 mentioned above. For example, the variable cross-section or stretching portion 25 may be provided in the form of at least one arcuate deflection 26 in the cross-sectional contour of the bridging element 22. In particular, this stretching portion 25 may be provided in the form of an indentation or protuberance in the cross-sectional contour of the bridging element 22, as may best be seen from FIGS. 5 to 9. An apex line 27 or an apex point of the loop-shaped or arcuate deflection 26 or the dome-type shape—FIG. 7, 8—of the bridging element 22 lies above a gliding surface of the running surface facing 10 formed by the bottom face 9 as viewed in cross-section. The cross-section of the bridging element 22 is preferably selected so that at least one recess 28 is formed, extending substantially parallel with the longitudinal centre axis of the gliding device 1 within the longitudinal extension of the bridging element 22. This recess 28 is formed in the bottom face 9 of the gliding device 1 and thus extends from the gliding surface on the bottom face 9 of the running surface facing 10 at least partially in the direction towards the top face 7 of the gliding device 1.

As may best be seen from FIGS. 5, 6 it may be preferable if the bridging element 22 has two loop-shaped deflections 28 which have an upwardly pointing dome shape as viewed in cross-section and are disposed essentially parallel with one another, extending in the longitudinal direction of the gliding device 1. The bridging element 22 may be made from any material that is as tear-resistant as possible and elastically deformable. The bridging element 22 is preferably made from a strip-shaped plastic layer 23, in particular from an elastomeric plastic, and the bridging element 22 is preferably produced by means of an injection moulding process, thereby enabling the desired profile or cross-sectional shape to be imparted to it. The bridging element 22 may optionally be made from a non-injection moulded plastic, in particular from a textile material. Such a textile or woven fabric is preferably provided with a coating, in particular of elastomeric plastic.

A thickness 29 of the bridging element 22 preferably corresponds to approximately a thickness 30 of the running surface facing 10. Accordingly, a thickness 29 of the bridging element 22 is expediently between 0.1 mm and 2 mm, in particular the thickness 29 of the bridging element 22 is approximately 1 mm.

In addition to having elastic properties, the bridging element 22 should also be as resistant to puncturing and tearing as possible. In particular, the bridging element 22 is of such a robust and tear-resistant design that when the tip of a conventional ski stick is placed on the bridging element 22 and force is applied to the ski stick by a person using the upper body, the bridging element 22 is not punctured. The bridging element 22 is preferably of such a robust and abrasion-resistant design that the performance of the gliding board body will not exhibit wear or abrasion to the degree that its performance would be detrimentally affected for at least five winter seasons of average use of the gliding board body due to frictional movements with respect to snow or ice. The tearing strength of the bridging element 22 is preferably selected so that a stone lying loose on a ski slope can not tear through or tear open the bridging element 22 as the gliding board body, in particular the ski 2, slides across such a stone.

At least the bottom face of the bridging element 22 facing the ground underneath the gliding board body may be provided with a coating which reduces its sliding friction and enhances its capacity to glide over snow or ice. This coating of the bridging element 22 intended to reduce frictional resistance with respect to snow or ice may be a layer of Teflon, gliding wax or similar, all being materials which reduce gliding friction.

The bridging element 22, which is able to stretch and rebound elastically at least in its transverse direction, may also be a layer incorporating several components. In particular, the bridging element 22 may have at least one reinforcing layer and at least one top layer. The bridging element 22 may also be of a transparent or diffuse colored design or permeable to light. The bridging element 22 may be produced by means of a multi-component injection moulding process in order to impart the desired contour and/or in order to form zones with different strength and/or elastic properties, for example. The bridging element 22 may also be provided with color-contrasting zones in a simple manner.

At least in its peripheral portions 33, 34, the bridging element 22 is designed so that a high-strength, adhesively or thermoplastically welded connection is produced with the adjoining layers or plies of the gliding board body.

As may also best be seen from FIGS. 5, 6, the bridging element 22 is preferably made as a separate component. This bridging element 22 is therefore joined to the two gliding board slats 16, 17 via its side peripheral portions 33, 34 extending substantially parallel with the side boundary edges 31, 32 of the slot 14. In particular, the side peripheral portions 33, 34 of the bridging element 24 sit against mutually facing side edges 35, 36 of the running surface facing 10 as far as possible without any gap. A width 37 of the bridging element 22 is preferably bigger than a clearance width 38 of the slot 14 to be bridged. In particular, the side peripheral portions 33, 34 of the bridging element 22 form overlap zones 39, 40 across which the bridging element 22 is positively, in particular adhesively, joined to the gliding board slats 16, 17. This adhesive connection is such that the bridging element 22 merges in these overlap zones 39, 40 or with the outer edges of the side peripheral portions 33, 34 as far as possible leaving no gaps in the running surface facing 10. In particular, gaps should be avoided as far as possible in the transition portion between the bridging element 22 and the running surface facing 10. The bottom face or bottom surface of the bridging element 22 thus lies predominantly, i.e. by more than 80%, above the bottom face 9 of the running surface facing 10 if the gliding device 1 is viewed in cross-section. The bottom face of the bridging element 22 is preferably disposed entirely above the bottom face 9 of the running surface facing 10. At its side peripheral portions 33, 34, the bridging element 22 adjoins the gliding surface or bottom face 9 of the running surface facing 10 in a flush arrangement (FIG. 5). The bridging element 22, which may have properties obtained by a different type of processing than the running surface facing 10, in particular exhibits a different type of behavior with respect to polishing processes, is preferably disposed at least predominantly above—FIG. 5, 6—or in its entirety but at a distance 41 above—the gliding surface or bottom face 9 of the running surface facing 10 as may best be seen from FIG. 7 or FIG. 8. This offers an effective and inexpensive way of avoiding any impairment to the bridging element 22 with its elastomeric properties during a polishing or any other processing operation carried out on the gliding surface of the running surface facing 10 and it is likewise able to undergo a polishing operation. This avoids any melting and prevents scoring or any other effects with respect to the bridging element 22, in particular its surface. In particular, this avoids the bridging element 22 for the slot 14 being subjected to a surface polishing treatment during production of the gliding device 1 or during the course of subsequent servicing work undertaken on the gliding device 1, in particular during surface polishing work.

Figure 7:
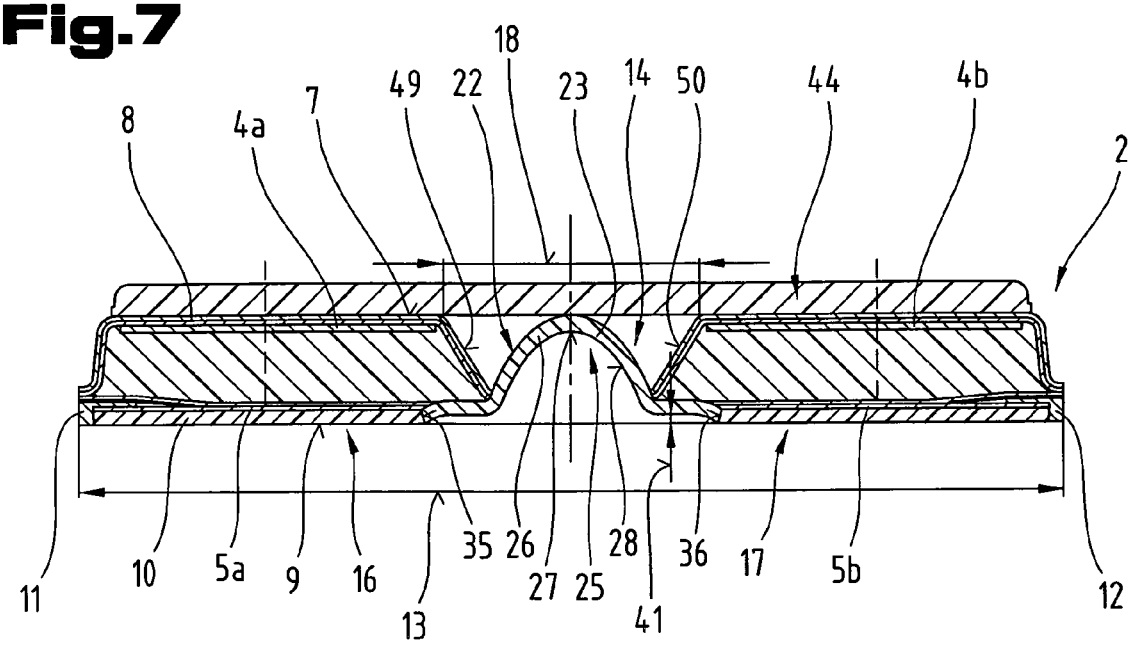
FIG. 7 is a simplified, schematic diagram in cross-section showing a board-type gliding device with a different embodiment of a bridging element for the central, longitudinally extending slot of the gliding board body.
Figure 8:
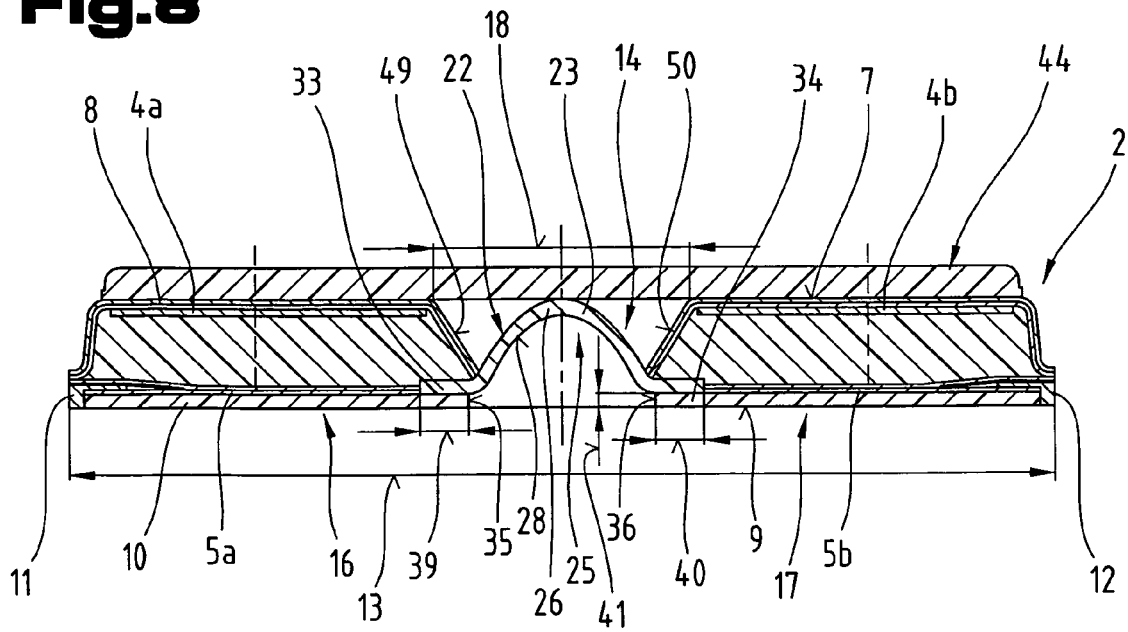
FIG. 8 is a simplified, schematic diagram in cross-section showing a board-type gliding device with another embodiment of a bridging element for the central, longitudinally extending slot.

The distance 41 between the bottom face 9 or between the gliding surface of the running surface facing 10 and the bottom surface of the bridging element 22 perpendicular to the running surface facing 10 may constitute a butting joint between the inner side edges of the running surface facing 10 and the outer side edges of the bridging element 22, as may be seen from FIG. 7. The transition portion is preferably provided in the form of a rounded region, as may be seen from FIG. 7. Alternatively, it would also be possible to provide a chamfer.

Another option is to provide lateral overlap zones 39, 40 of the bridging element 22 so that these overlap zones 39, 40 are positioned on the side of the running surface facing 10 directed towards the core 6. Within these overlap zones 39, 40, the bridging element 22 is preferably joined to the running surface facing 10 by means of a plastic welded joint. In particular, the overlap zones 39, 40 of the bridging element 22 may be integrally accommodated in the gliding board slats 16, 17 respectively, as may be seen from FIG. 8 for example. The distance 41 in this instance is approximately 0.5 mm to 3 mm. Mutually facing peripheral portions or transition zones of the running surface facing 10 in the direction towards the bridging element 22 may also be provided with a chamfer or rounded region in order to avoid any sharp-edged transitions within the running surface facing 10.

Figure 9:
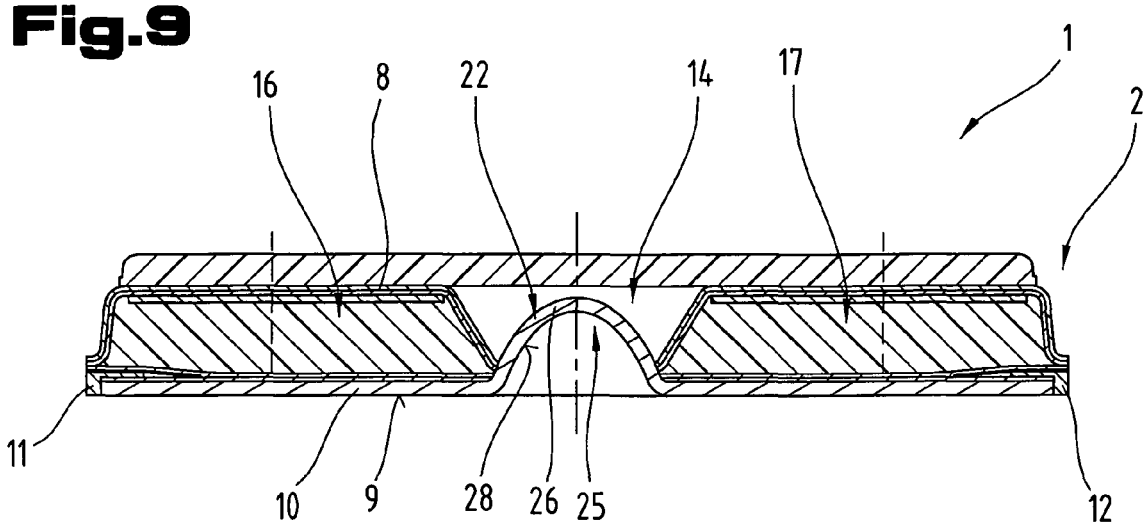
FIG. 9 is a simplified, schematic diagram in cross-section showing another embodiment of a board-type gliding device, in particular a ski, the side shape of which can be varied.

As illustrated by the embodiment shown in FIG. 9, the bridging element 22 and the running surface facing 10 may be formed by an integral plastic ply or plastic layer, which extends seamlessly and without any interruptions between the two outer edges or control edges 11, 12 of the gliding device 1. In this case, a loop-shaped deflection 26 is provided in the central portion of the running surface facing 10, which is preferably produced by a process of thermal forming in the running surface facing 10 and to this end the latter is made from a heat-deformable plastic or incorporates elements made from a heat-deformable plastic.

Figure 2:
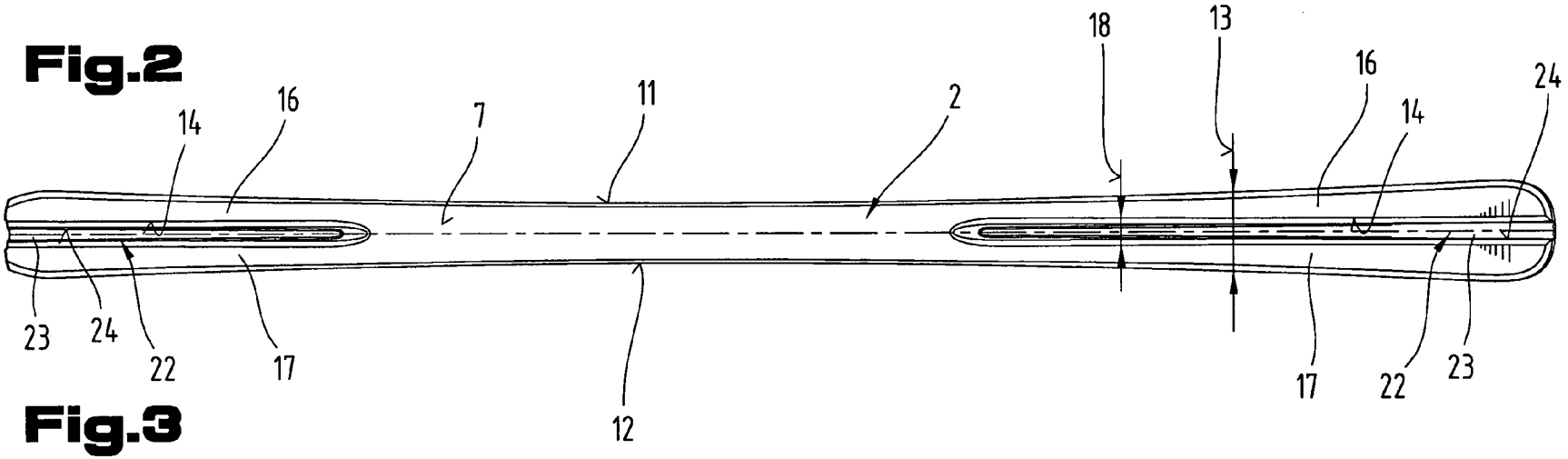
FIG. 2 is a simplified, schematic plan view of the gliding board body illustrated in FIG. 1 without the geometry-influencing means.
Figure 3:
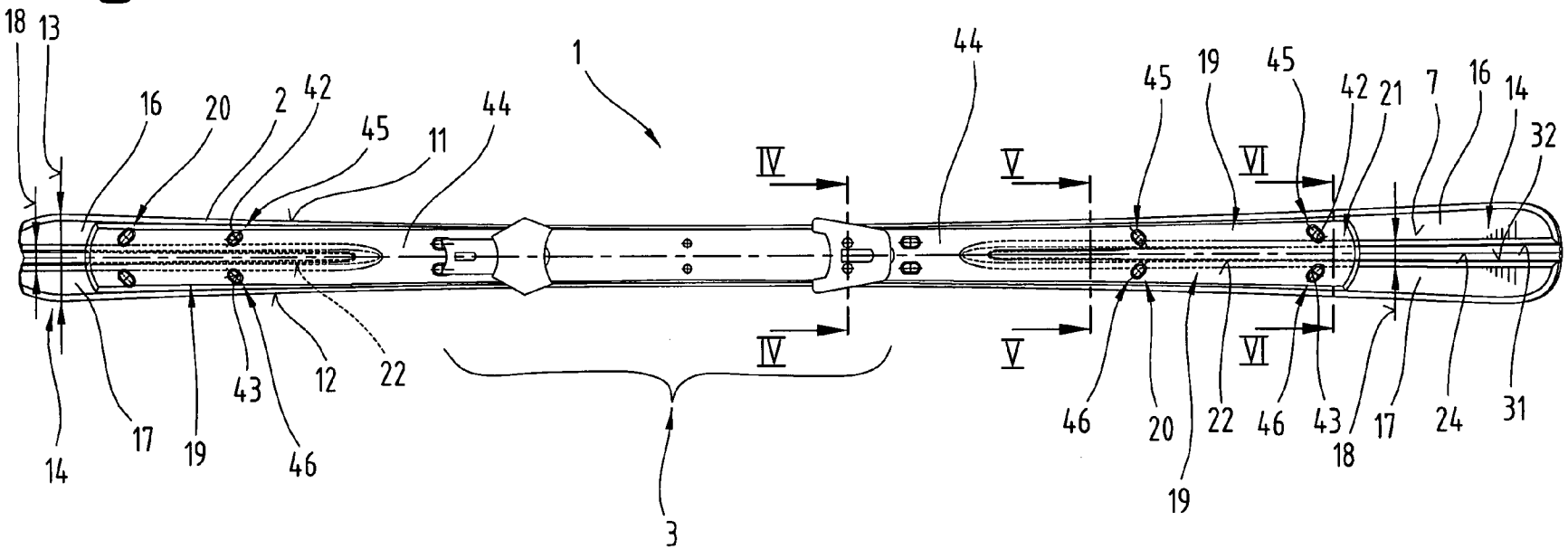
FIG. 3 shows a ski similar to that of FIG. 1 viewed from above.

As may best be seen from FIGS. 1 to 3, it is of advantage if, by reference to the oppositely lying ends of the gliding board body in the longitudinal direction, a front or first slot 14 and a rear or second slot 14 is provided. In particular, the front slot 14 extends from a front end portion of the binding mounting portion, or from the vicinity of the mounting portion for the binding mechanism 3 in the direction, towards the front end, in particular through to the shovel portion of the gliding board body. The rear slot 14 extends from a rear end portion of the binding mounting portions, or from the vicinity of the mounting portion for the binding mechanism 3 in the direction, towards the rear end, in particular as far as the rearmost end point of the gliding board body. At least the mounting portion for the binding mechanism 3 and optionally the zones adjoining it are not slotted. In the binding mounting zone, the slot 14 may optionally merge into a groove formed in the top face 7 of the gliding board body. If the gliding board body is viewed from above, this therefore results in an essentially X-shaped structure, as may best be seen from FIG. 2.

It is preferable if both the front slot 14 and the rear slot 14 of the gliding board body are provided with at least one geometry-influencing means 19, as may be seen from the diagrams shown in FIGS. 1 and 3. This makes it possible to vary or exert a pronounced influence on the so-called side-cut or contour radius and the travel behavior of the gliding board body.

The bridging element 22 is preferably designed, in particular shaped and/or of an elastic design so that, in an end portion lying closest to the end of the gliding board body, it effects an elastic extension of at least 10 mm in terms of its width 37 without being subjected to damage. In other words, an elastic stretching and rebounding action of the bridging element 22 of 10 mm at its end remote from the binding mounting portion will not cause damage, in particular will not lead to tearing, breakage or overstretching of the bridging element 22.

The geometry-influencing means 19 co-operating with the slotted end portions of the gliding board body may be designed so that a width 18 of the slot 14 can be varied and individually pre-set to enable the travel or turning behavior of the gliding board body to be adapted to suit the individual wishes or requirements of the user to the best possible degree. Alternatively or in combination, the geometry-influencing means 19 may also be designed so that it causes a variability in the width 18 of the slot 14 as a function of load or flexing of the gliding board body, as explained above. The geometry-influencing means 19 preferably has at least one prising means 20 for providing an individually adjustable variation or a variation dependent on load in the width 18 of the slot 14.

As may best be seen from FIGS. 1 and 3, the prising means 20 has, by reference to a plane extending essentially parallel with the running surface facing 10, at least two support or guide surfaces 42, 43 extending at an angle with respect to the longitudinal axis of the gliding board body. By reference to the longitudinal centre axis of the gliding board body, these support or guide surfaces 42 are disposed in a V-shape with respect to one another and the longitudinal centre axis of the gliding board body constitutes a bisecting straight line. In particular, the angle subtended between two obliquely extending support or guide surfaces 42, 43 is essentially bisected by the imaginary longitudinal axis of the gliding board body, as may best be seen from FIG. 3. These support or guide surfaces 42, 43 are preferably disposed in a plate-type force-transmitting element 44 and due to their orientation extending at an angle relative to the longitudinal axis of the gliding board body produce a wedging or prising effect with respect to the slotted portion(s) of the gliding board body. It is preferable to provide several pairs of support or guide surfaces 42, 43 spaced at a distance apart from one another in the longitudinal direction of the gliding board body or force-transmitting element 44.

This plate-type force-transmitting element 44 is supported on the top face 7 of the gliding board body and is retained on the gliding board body in at least one of its end portions so that it is able to move relative to its top face 7. The support or guide surfaces 42, 43 of the force-transmitting element 44 oriented in a V-shape with respect to one another are preferably provided in the form of elongate holes 45, 46 extending at an angle with respect to the longitudinal centre axis of the force-transmitting element 44, the walls of which constitute the support or guide surfaces 42, 43. Via these elongate holes 45, 46 and by means of appropriate screw means, the force-transmitting element 44 is connected to the gliding board body, in particular to its top face 7, and retained so that it is able to effect relative movements, and at least one of the ends of the force-transmitting element 44 is still capable of moving in the longitudinal direction relative to the gliding board body. The latter is joined to the top face 7 of the gliding board body so that it is fixed in all directions, preferably in the middle portion of the force-transmitting element 44. This may be achieved using circular bores and appropriate screw means, as schematically illustrated in FIG. 1.

The support or guide surfaces 42, 43 in or on the plate-type force-transmitting element 44 co-operate with thrust surfaces 47, 48 on the top face 7 of the gliding board body. Alternatively, the obliquely extending support or guide surfaces 42, 43 of the force-transmitting element 44 may also co-operate with mutually facing inner longitudinal side walls 49, 50 of the slot 14, as indicated by broken lines in FIG. 5 for example. In particular, projections 51, 52 are provided on the bottom face of the force-transmitting element 44, as indicated by broken lines. These projections 51, 52 extending parallel with or at an angle with respect to the longitudinal centre axis of the gliding board body may co-operate with thrust surfaces 47, 48 in the slot 14 or in the peripheral portions of the slot 14 extending at an angle with respect to the longitudinal centre axis of the gliding board body, thereby forming the prising means 20. However, the thrust surfaces 47, 48 may also be formed by projections 53, 54 fixedly joined to the top face 7 of the gliding board body, in particular by means of screws 55, 56 or their screw heads.

The preferably plate-shaped force-transmitting element 44 incorporating the support or guide surfaces 42, 43 or incorporating the obliquely positioned elongate holes 45, 46 extends across more than 50% of the length of the gliding board body in the case of the embodiment illustrated in FIG. 1. In particular, the ends of the plate-type force-transmitting element 44 overlap with the slots 14 in the gliding board body. In particular, the two end portions of the force-transmitting element 44 overlap with at least part-portions of the two slots 14 at the terminal ends the gliding board body when the force-transmitting element 44 is placed on the top face 7 of the gliding board body, as may best be seen from FIG. 3. The distal ends of the force-transmitting element 44 are therefore still able to move relative to the top face 7 of the gliding board body in its longitudinal direction so that relative displacements between the force-transmitting element 44 and the gliding board body will cause a prising open or narrowing of the slot 14 in the gliding board body, thereby constituting the geometry-influencing means 19.

As may best be seen from FIG. 5, the top layer 8 of the gliding board body is preferably provided in the form of a plastic layer which is decorated on at least one side. This top layer 8 constitutes the predominant part-portion of the top face 7 of the gliding board body. This top layer 8 preferably also lines at least part-portions of the mutually facing longitudinal side walls 49, 50 of the slot 14, as may best be seen from FIGS. 5, 6.

Figure 10:
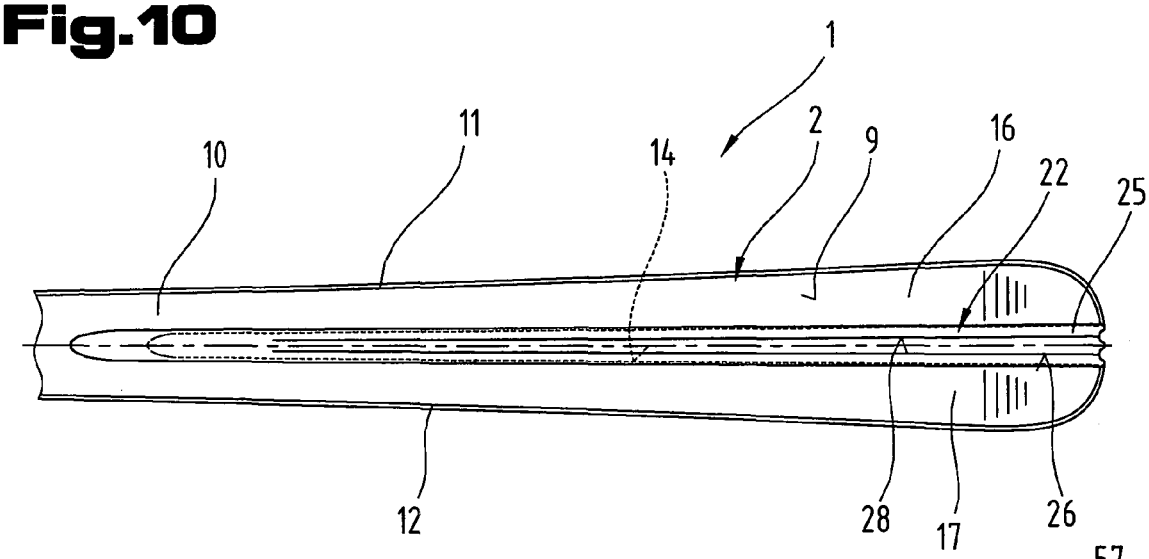
FIG. 10 is a simplified diagram illustrating an example of the bottom face of the board-type gliding device, in particular a ski, in what is its front part-portion by reference to the direction of travel.

FIG. 10 illustrates the bottom face 9 of the front end portion of a board-type gliding device 1, in particular a ski 2. The slot 14 reducing the transverse stiffness of the gliding board body or cut through all the strength-imparting layers of the gliding board body again extends from the binding mounting portion or middle portion of the gliding board body continuously as far as what is the front end portion of the gliding board body by reference to the direction of travel, i.e. also within the upwardly curved, front ski shovel. The front ski end with its longitudinally extending slot 14 or cut therefore forms at least two gliding board slats 16, 17 extending from the binding mounting portion. The slot 14 or cut is bridged or overlapped by the elastically stretchable bridging element 22, which bridging element 22 has barely any or only a marginal influence on the stiffness or flexibility of the gliding board slats 16, 17. In the end portion lying closest to the ski shovel, the bridging element 22 has a high elastic stretching or expansion capacity. To this end, the bridging element 22 preferably has at least one stretching portion 25 based on at least one shaped region, in particular at least one loop-shaped or fold-shaped deflection 26.

In an end portion of the slot 14 lying closest to the binding mounting portion, in particular in what is a rear end portion of the front slot 14 by reference to the direction in which the gliding board body moves off forward, the proportion of elastic stretching capacity based on the shaped region is significantly lower than the elastic stretching capacity of the bridging element 22 in the shovel portion. In particular, the shape or contour of the bridging element 22 becomes progressively narrower from the shovel portion in the direction towards the binding mounting portion. The at least one transverse contour of the stretching portion 25 in the bridging element 22 preferably diminishes altogether or at least more or less so starting from the ski tip in the direction towards the binding mounting portion. In other words, the at least one loop-shaped deflection 26 preferably decreases continuously in terms of its height or loop width starting from the ski tip in the direction towards the binding mounting portion. In particular, a profile height of the bridging element 22 becomes progressively shorter starting from the outermost end of the gliding board body in the direction towards the binding mounting portion.

In the vicinity of the rear end of the slot 14, the bridging element 22 is then of a plate-type or flat or largely flat cross-section. This flattening or reduction in the profile height of the bridging element 22 may also be seen from a comparison of FIGS. 5, 6 in conjunction with FIG. 3, for example. In the end portion facing the binding mounting portion, the bridging element 22 preferably merges into the running surface facing 10 in a flat or flush arrangement. In other words, the rear end portion of the bridging element 22 for the front slot 14 in the gliding board body adjoins the running surface facing 10 in an at least approximately flat and stepless arrangement and thus constitutes a virtually extended running or gliding surface in this rear end portion. In particular, the at least one recess 28 in the bridging element 22 gradually diminishes altogether from the front shovel portion in the direction towards the binding mounting portion. The recess 28 preferably becomes flat or disappears totally in the rear end portion of the bridging element 22 lying closest to the binding mounting portion, thereby resulting in a gradual, diminishing and disappearing transition between the recess 28 and the bottom face 9 or gliding surface of the gliding board body, as may be seen from the disappearing centre line in FIG. 10.

One particular advantage of the embodiment illustrated in FIG. 10 resides in the fact that an accumulation or build-up snow in the slot 14 or in the recess 28 of the gliding board body is prevented in spite of the fact that a longitudinally extending slot 14 or cut is provided in front of the binding mounting portion—by reference to the direction in which the gliding board body glides or moves forwards—resulting in the best possible gliding behavior, in particular as low as possible a gliding resistance. Since the bridging element 22 has a more pronounced contour in the region of the shovel portion of the gliding board body or at least one recess 28 is provided, a sufficiently large widening or narrowing of the shovel portion is also made possible. Furthermore, an improved guiding action of the gliding board body is obtained on relatively soft ground, in particular on snow, due to the at least one recess 28 in the stretching portion 25 of the elastic bridging element 22 because the recess 28 is able to act as a guide groove in such situations, thereby enabling the guidance or tracking of the gliding board body to be improved.

Figure 11:
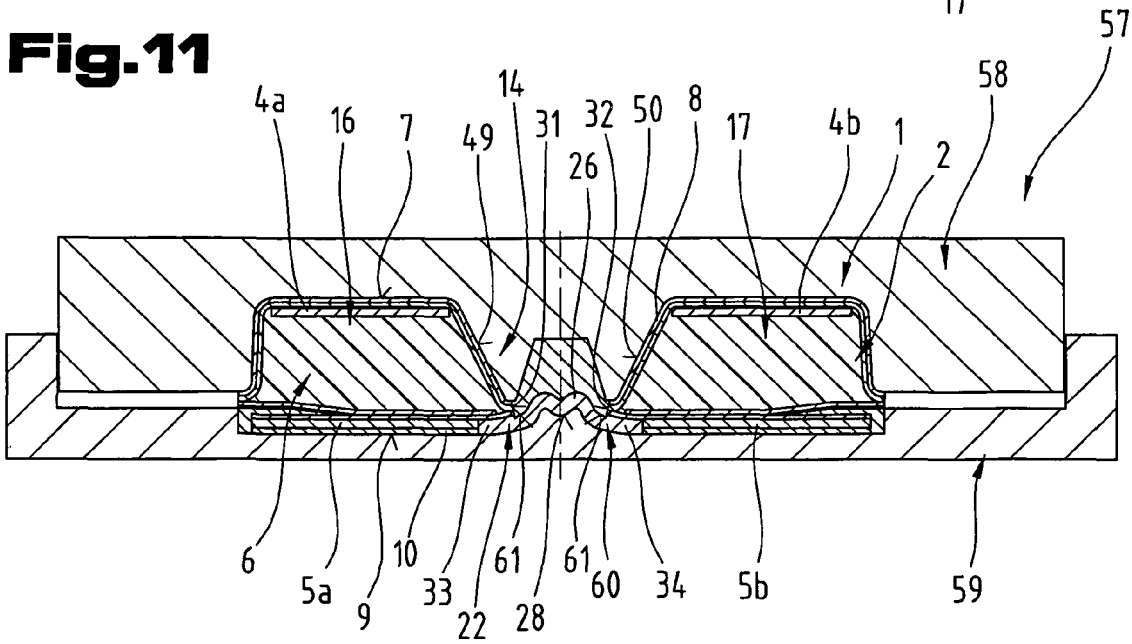
FIG. 11 is a simplified, schematic diagram showing the gliding board body during manufacture by means of a heat press.

FIG. 11 provides a schematic illustration of part of the sequence involved in the advantageous method used to manufacture the multi-layered gliding board body, in particular for the board-type gliding device 1 in the form of a ski 2 or snowboard. In a manner known per se, the individual plies or layers are joined to one another in a hot pressing operation, in particular using a hot press 57 with at least two pressing moulds 58, 59 in order to form the multi-layered gliding board body. The method used to produce this sandwich construction of the gliding board body comprises at least the following steps.

At least the following layers or materials are placed in or introduced into an open or operation-ready hot press 57 with appropriately shaped pressing moulds 58, 59:

at least a top layer 8 constituting the top face 7 of what will subsequently be the gliding device 1, which is decorated on one side or still has to be decorated; also, at least one layer for forming the strength-imparting top belt 4, which top belt 4 is made from metal materials and/or plastic and/or from materials which firstly have to be rendered capable of flowing or pasty and then cured, e.g. a so-called prepreg; at least one component constituting the core 6 of what will ultimately be the gliding board body and/or a foamed plastic which is cured over time and constitutes the core 6, in particular PU foam; at least one layer constituting the strength-imparting bottom belt 5 of what will subsequently be the gliding board body; at least one running surface facing 10 constituting the bottom face 9 of the gliding board body and at least one adhesive layer or adhesive compound in the form of a hot-melt adhesive, epoxy resin or PU foam, which free-flowing filler or adhesive substance for the gliding board body is not sprayed or injected in until the hot press 57 has been closed.

In addition to the layers, components or material compounds listed above, other functional elements may be placed in or introduced into the hot press 57, such as partial reinforcing layers or fittings for binding mounts, damping layers, reinforcing plies and similar functional elements, for example. This will primarily vary depending on the desired embodiment or properties of the gliding board body to be produced.

Before placing the running surface facing 10 in the hot press 57, the running surface facing 10 is processed or prepared as follows.

By reference to the width 13 of the gliding board body to be produced, at least one slot 14 is cut or punched into approximately the middle portion of the running surface facing 10. The slot 14 or cut in the running surface facing 10 extends essentially parallel with the longitudinal axis of the running surface facing 10. Such a slot 14 is also provided in the other components of the gliding body and in particular a slot 14 is disposed in an essentially congruent position in the layers used for the top layer 8, the bottom belt 5, the top belt 4 and/or in the core component of the gliding board body.

Disposed inside this slot 14 or above this slot 14 in the running surface facing 10 is an elastically stretchable or expandable bridging element 22, the dimensions of which are the same as, bigger or slightly smaller than the slot 14 cut through the running surface facing 10. This bridging element 22 is fabricated as a separate component and is preferably made as an injection moulded part. The main thing is that the elastically stretchable bridging element 22 provides full-surface coverage for the cut or punched part, in particular the slot 14 in the running surface facing 10, or bridges it without any gaps.

When the requisite layers have been introduced into the hot press 57, the hot pressing operation, which is known per e, is activated in order to provide an adhesive join between the layers introduced into the hot press 57 to form the multi-layered gliding board body. The essential factor is that the bridging element 22 is simultaneously adhesively joined by its peripheral portions 33, 34 to the gliding board body, in particular to its gliding board slats 16, 17, so that the slot 14 in the strength-imparting layers of the gliding board body produced as a result and the essentially congruently disposed slot 14 in the running surface facing 10 of the gliding board body are bridged by an elastic stretching and rebounding arrangement.

It is also expedient to provide a slot in the top layer 8 at least in one end portion in the longitudinal direction prior to introducing it into the hot press 57 so that the top layer 8 forms or lines at least portions of the longitudinal side walls 49, 50 of the slot 14 whilst the hot pressing operation is being performed. As a result, the thermoplastic top layer 8 will be forced by means of the pressing mould 58 at least partially into the slot 14 of the gliding board body so that a fluid-tight or adhesive-proof lining is formed for the longitudinal side walls 49, 50 of the slot 14. In particular, the top layer 8 prevents any molten or pasty adhesive or PU foam from getting or leaking out of the two gliding board slats 16, 17 whilst the hot pressing operation is running.

The individual layers of the gliding board body are specifically joined by means of interposed layers of hot-melt adhesive and/or by means of foamed plastics injected into the cavity of the hot press 57, in particular PU foams, which are cured under the effect of temperature and over time.

It is also expedient to provide slots in the layer that will form the top belt 4, the component used to form the core 6 and the layer that will form the bottom belt 5 prior to introducing them into the hot press 57 in at least one end portion in their longitudinal direction so that the gliding board body slotted in its longitudinal direction is already produced during the hot pressing operation during which the layers introduced into the hot press 57 are being adhesively joined. The shape is imparted to the gliding board body by the contours of the mould cavity of the hot press 57 and by the expanding adhesive or foam layers. There is no need for a finishing process involving the removal of material from a gliding board body in order to produce the longitudinal cut when using the manufacturing method proposed by the invention.

Ideally, when the hot press 57 is closed, in particular during the phase when the pressing moulds 58, 59 are correctly closed as intended, a compression or pressing force is exerted on the surface of the elastically stretchable and rebounding bridging element 22. This compression or pressing force is preferably expended by at least one of the pressing moulds 58, 59 or at least one pressing body disposed in or on the pressing moulds 58, 59. The purpose of this compression or pressing force on the surface of the elastically stretchable and rebounding bridging element 22 is to assure a tight seal between the two cavities for forming the two gliding board slats 16, 17 and prevent any adhesive from getting out of the mould interior and moving in the direction towards the slot 14 or in the direction towards the top face of the bridging element 22. This results in as stable and inexpensive a production method as possible, by means of which high-quality gliding board bodies can be produced, and the slot is already formed in the longitudinal direction during the step of adhesively joining the individual layers of the gliding board body.

A sealing edge 60 is preferably provided in those part-portions of the pressing mould 58 by which the shape or contour for the slot 14 in the gliding board body is defined. In particular, at least one web-type sealing lip 61 is provided in the peripheral portions of the pressing mould 58 lying closest to the slot 14. This sealing edge 60 or the corresponding sealing lip 61 is forced in a sealing arrangement into the surface of the elastic bridging element 22 whilst the hot press 57 is closed and active and thus prevents any molten or pasty adhesive from getting out of the two gliding board slats 16, 17 and moving in the direction towards the slot 14 or in the direction towards what will ultimately be the gliding board body top face which lies free and the surface of the bridging element 22 during the hot pressing operation. As a result, the gliding board body basically needs no finishing work in the transition portion between the bridging element 22 and the inner longitudinal side walls 49, 50 of the slot 14 after the hot pressing operation and when removed from the hot press 57. In particular, this offers a simple and reliable way of preventing adhesive from getting out of the gliding board slats 16, 17 and the surfaces of the elastically stretchable bridging element 22 remain free of contamination by adhesive or PU foam. The above-mentioned molten or pasty adhesives are absolutely necessary during the hot pressing operation in order to produce an adhesive join between the individual layers or plies of the gliding board slats 16, 17 of the gliding board body in the interior of the gliding board body. Complex milling or polishing operations, which might be difficult to control, to produce a clean transition zone between the bridging element 22 and the longitudinal side walls 49, 50 of the slot 14 can advantageously be dispensed with.

The inner or pressing surface of at least one pressing mould 58, 59 is designed with a contour or profile which is such that the bridging element 22, having been placed in the hot press 57 separately or together with the running surface facing 10, is supported by at least one of the pressing moulds 58, 59 and/or by the contour or profile of at least one of the pressing moulds 58, 59 relative the mould interior so that it can be positioned correctly and in an exact fit. In particular, this enables the bridging element 22 and/or the running surface facing 10 to be positioned exactly relative to the mould cavity and retained to prevent any undesired slipping of the bridging element 22 and/or the running surface facing 10.

The embodiments illustrated as examples represent possible design variants of the board-type gliding device 1 and of a production method and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

For the sake of good order, finally, it should be pointed out that, in order to provide a clearer understanding of the structure of the part-feeding system, it and its constituent parts are illustrated to a certain extent out of scale and/or on an enlarged scale and/or on a reduced scale.

Above all, the individual embodiments of the subject matter illustrated in FIGS. 1, 2, 3, 4, 5, 6; 7; 8; 9; 10; 11 constitute independent solutions proposed by the invention in their own right. The objectives and associated solutions proposed by the invention may be found in the detailed descriptions of these drawings.

LIST OF REFERENCE NUMBERS

| | |
|---|---|
| 1 | Gliding device |
| 2 | Ski |
| 3 | Binding mechanism |
| 4 | Top belt |
| 4a | Top belt strand |
| 4b | Top belt strand |
| 5 | Bottom belt |
| 5a | Bottom belt strand |
| 5b | Bottom belt strand |

-continued

| | |
|---|---|
| 6 | Core |
| 7 | Top face |
| 8 | Top layer |
| 9 | Bottom face |
| 10 | Running surface facing |
| 11 | Control edge |
| 12 | Control edge |
| 13 | Width |
| 14 | Slot |
| 15 | Depth direction |
| 16 | Gliding board slat |
| 17 | Gliding board slat |
| 18 | Width |
| 19 | Geometry-influencing means |
| 20 | Prising means |
| 21 | Prising angle |
| 22 | Bridging element |
| 23 | Plastic layer |
| 24 | Expansion fold |
| 25 | Stretching portion |
| 26 | Deflection |
| 27 | Apex line |
| 28 | Recess |
| 29 | Thickness |
| 30 | Thickness |
| 31 | Boundary edge |
| 32 | Boundary edge |
| 33 | Peripheral portion |
| 34 | Peripheral portion |
| 35 | Side edge |
| 36 | Side edge |
| 37 | Width |
| 38 | Clearance width |
| 39 | Overlap zone |
| 40 | Overlap zone |
| 41 | Distance |
| 42 | Support or guide surface |
| 43 | Support or guide surface |
| 44 | Force-transmitting element |
| 45 | Elongate hole |
| 46 | Elongate hole |
| 47 | Thrust surface |
| 48 | Thrust surface |
| 49 | Longitudinal side wall |
| 50 | Longitudinal side wall |
| 51 | Projection |
| 52 | Projection |
| 53 | Projection |
| 54 | Projection |
| 55 | Screw |
| 56 | Screw |
| 57 | Hot press |
| 58 | Pressing mould |
| 59 | Pressing mould |
| 60 | Sealing edge |
| 61 | Sealing lip |

What is claimed is:

1. Ski or snowboard in the form of a board-type gliding device, with a multi-layered gliding board body comprising at least one strength-imparting top belt, at least one strength-imparting bottom belt, at least one core disposed in between, at least one top layer constituting the top face of the gliding board body and at least one running surface facing constituting the bottom face of the gliding board body, and, at least one slot is provided in a middle portion of the gliding board body, which extends in the depth direction from the top face of the gliding board body in the direction towards the running surface facing and in a slot longitudinal direction, wherein the slot longitudinal direction is essentially parallel with a gliding board body longitudinal direction of the gliding board body to produce a cross-sectional weakening and reduce the stiffness of the gliding board body transversely to the gliding board body longitudinal direction and having at least one geometry-influencing means for producing a cross-sectional shape or contour of the gliding board body that is variable as a function of load, can be manually varied, or is variable as a function of load and can be manually varied, wherein the slot is covered by a bridging element which is elastically stretchable or widenable at least transversely to the longitudinal extension of the slot and the bridging element is designed so that it prevents snow from passing or getting inside the slot from the running surface facing in the direction towards the top face of the gliding board body.

2. Ski or snowboard as claimed in claim 1, wherein the bridging element has at least one elastically stretchable and rebounding stretching portion.

3. Ski or snowboard as claimed in claim 2, wherein the stretching portion is provided in the form of at least one loop-shaped deflection or shape of the cross-sectional contour of the bridging element.

4. Ski or snowboard as claimed in claim 3, wherein an apex line of the deflection or shape of the bridging element lies above a gliding surface of the running surface facing.

5. Ski or snowboard as claimed in claim 3, wherein the bridging element has two upwardly pointing deflections of a dome shape as viewed in cross-section, extending in the longitudinal direction of the gliding board body.

6. Ski or snowboard as claimed in claim 1, wherein the bridging element has at least one reversibly variable stretching portion in its cross-sectional shape.

7. Ski or snowboard as claimed in claim 1, wherein the bridging element forms at least one recess in the gliding surface of the running surface facing extending essentially parallel with the longitudinal center axis of the gliding board body.

8. Ski or snowboard as claimed in claim 1, wherein the bridging element contains woven fabric or textile substances or is formed by a plastic layer, the thickness of which approximately corresponds to a thickness of the running surface facing.

9. Ski or snowboard as claimed in claim 1, wherein the bridging element has a thickness of 0.1 mm to 2 mm, in particular a thickness of approximately 1 mm.

10. Ski or snowboard as claimed in claim 1, wherein the bridging element is made as a separate component for the gliding board body and is adhered or thermoplastically welded to the gliding board slats extending on either side of the longitudinal axis of the slot by its side peripheral portions extending essentially parallel with boundary edges of the slot.

11. Ski or snowboard as claimed in claim 1, wherein a width of the bridging element is bigger than a clearance width of the slot to be bridged.

12. Ski or snowboard as claimed in claim 1, wherein the bridging element merges into the running surface facing steplessly, without leaving any gaps, or both steplessly and without leaving any gaps, at its side peripheral portions via its bottom face.

13. Ski or snowboard as claimed in claim 1, wherein the bridging element and the running surface facing are formed by an integral plastic layer which extends seamlessly and without interruption between the two outer edges or control edges of the gliding board body.

14. Ski or snowboard as claimed in claim 1, wherein the bridging element is designed so that it is able to withstand an elastic expansion of up to 10 mm in its width in the end portion of the gliding board body without sustaining damage.

15. Ski or snowboard as claimed in claim 1, wherein the slot splits or divides the strength-imparting top belt and the strength-imparting bottom belt essentially within the longitudinal extension of the slot into a first and a second top belt strand and into a first and a second bottom belt strand.

16. Ski or snowboard as claimed in claim 1, wherein the slot extends or several slots aligned in a row with one another in the longitudinal direction of the gliding board body extends across 40% to 80% of the length of the gliding board body.

17. Ski or snowboard as claimed in claim 1, wherein the slot extends across 50% to 95% of the front longitudinal portion between a binding mechanism and the front end of the gliding board body.

18. Ski or snowboard as claimed in claim 1, wherein the slot also extends through the front, upwardly curved shovel portion and extends completely through its layers imparting transverse stiffness.

19. Ski or snowboard as claimed in claim 1, wherein a first slot extends from a front end portion of a mounting portion for a binding mechanism in the direction towards the front shovel portion of the gliding board body and a second slot extends from a rear end portion of a mounting portion for a binding mechanism in the direction towards the rear end of the gliding board body.

20. Ski or snowboard as claimed in claim 1, wherein the geometry-influencing means is designed so that a width of the slot can be individually adjusted and pre-set.

21. Ski or snowboard as claimed in claim 1, wherein the geometry-influencing means is designed to cause a variability in the width of the slot as a function of the load or flexing of the gliding board body.

22. Ski or snowboard as claimed in claim 1, wherein the geometry-influencing means has at least one prising means for individually and adjustably increasing the width of the slot and/or at least one prising means for varying the width of the slot as a function of the flexing of the gliding board body.

23. Ski or snowboard as claimed in claim 22, wherein, by reference to a plane extending essentially parallel with the running surface facing, the prising means has at least two support or guide surfaces extending at an angle with respect to the longitudinal axis of the gliding board body, which co-operate with thrust surfaces on the top face of the gliding board body or with longitudinal side walls of the slot.

24. Ski or snowboard as claimed in claim 23, wherein the thrust surfaces are formed on projections fixedly connected to the gliding board body, such as screws or screw heads, for example.

25. Ski or snowboard as claimed in claim 1, wherein the top layer is provided in the form of a plastic layer and lines the predominant part-portion of the top face as well as mutually facing longitudinal side walls of the slot.

26. Ski or snowboard as claimed in claim 1, wherein the at least one slot extends essentially in a V-shape or dovetail shape when the top face of the gliding board body is viewed from above, and the biggest width of the slot is disposed in the end portion remote from the binding mounting portion.

27. Ski or snowboard as claimed in claim 1, wherein the at least one slot has a length of between 20 cm and 100 cm when the top face of the gliding board body is viewed from above and a width or a clearance width of the slot is between 10 mm and 20 mm in its longitudinal middle portion.

28. Ski or snowboard as claimed in claim 1, wherein side peripheral portions for providing a connection of the bridging element to the mutually facing longitudinal side walls of the slot are positioned closer to the running surface facing than the top face of the gliding board body relatively speaking.

29. Ski or snowboard as claimed in claim 1, wherein a profile height of the bridging element decreases progressively from an outer end of the gliding board body in the direction towards the binding mounting portion.

* * * * *